US011525089B2

(12) United States Patent
Bowser, Jr.

(10) Patent No.: US 11,525,089 B2
(45) **Date of Patent: *Dec. 13, 2022**

(54) STACKED SLAB COKE OVEN CORBEL STRUCTURES

(71) Applicant: FOSBEL, INC., Brook Park, OH (US)

(72) Inventor: Alan E. Bowser, Jr., Brook Park, OH (US)

(73) Assignee: FOSBEL, INC., Brook Park, OH (US)

( * ) Notice: Subject to any disclaimer, the term of this patent is extended or adjusted under 35 U.S.C. 154(b) by 339 days.

This patent is subject to a terminal disclaimer.

(21) Appl. No.: 17/056,882

(22) PCT Filed: May 23, 2018

(86) PCT No.: PCT/US2018/034120
§ 371 (c)(1),
(2) Date: Nov. 19, 2020

(87) PCT Pub. No.: WO2019/226159
PCT Pub. Date: Nov. 28, 2019

(65) Prior Publication Data

US 2021/0189246 A1 Jun. 24, 2021

Related U.S. Application Data

(63) Continuation-in-part of application No. 29/607,559, filed on Jun. 14, 2017, now abandoned, and a continuation-in-part of application No. 29/607,563, filed on Jun. 14, 2017, now abandoned.

(51) Int. Cl.
*C10B 29/02* (2006.01)
*F27D 1/06* (2006.01)

(52) U.S. Cl.
CPC ..... *C10B 29/02* (2013.01); *F27D 1/063* (2013.01)

(58) Field of Classification Search
CPC ..... C10B 29/02
See application file for complete search history.

(56) References Cited

U.S. PATENT DOCUMENTS

| | | | |
|---|---|---|---|
| 6,066,236 | A | 5/2000 | Gilroy |
| 8,266,853 | B2 | 9/2012 | Bloom et al. |
| 8,640,635 | B2 | 2/2014 | Bloom et al. |
| 10,253,980 | B2 * | 4/2019 | Bowser, Jr. ..... C10B 29/02 |
| 10,336,942 | B2 * | 7/2019 | Bowser, Jr. ..... F27D 1/04 |
| 10,927,302 | B2 * | 2/2021 | Bowser, Jr. ..... F27D 1/0006 |

(Continued)

OTHER PUBLICATIONS

International Search Report for PCT/US2018/034120, dated Dec. 17, 2018, 3 pages.

(Continued)

*Primary Examiner* — Jonathan Luke Pilcher
(74) *Attorney, Agent, or Firm* — Nixon & Vanderhye P.C.

(57) ABSTRACT

Coke oven corbel structures are provided with a multiple number of stacked refractory slabs defining a corresponding multiple number of tiers of the corbel structure, The multiple number of stacked refractory slabs define a pair of substantially vertically oriented central fuel gas passageways and pairs of combustion air passageways laterally of a respective one of the central fuel gas passageways. A plurality of vertically stacked fuel gas blocks each defining a central fuel gas conduit may be positioned within each of the central fuel gas passageways.

9 Claims, 44 Drawing Sheets

(56) References Cited

U.S. PATENT DOCUMENTS

| | | | | |
|---|---|---|---|---|
| 2010/0287871 | A1* | 11/2010 | Bloom | C10B 29/02<br>52/505 |
| 2016/0145494 | A1 | 5/2016 | Bowser, Jr. | |
| 2016/0264870 | A1 | 9/2016 | Bowser, Jr. | |
| 2016/0281983 | A1 | 9/2016 | Bowser, Jr. et al. | |
| 2018/0362854 | A1* | 12/2018 | Bowser, Jr. | C10B 29/02 |

OTHER PUBLICATIONS

Written Opinion of the ISA for PCT/US2018/034120, dated Dec. 17, 2018, 6 pages.

* cited by examiner

STACKED SLAB COKE OVEN CORBEL STRUCTURES

CROSS-REFERENCE TO RELATED APPLICATION

This application is the U.S. national phase of International Application No. PCT/US2018/034120 filed May 23, 2018, which designated the U.S. and is a continuation-in-part (CIP) of commonly owned copending U.S. Design patent application Ser. Nos. 29/607,559 and 29/607,563 each filed on Jun. 14, 2017, the entire contents of each such prior filed application being expressly incorporated hereinto by reference.

FIELD

The embodiments disclosed herein relate generally to coke ovens, especially corbel structures associated with coke ovens. In preferred embodiments, the corbel structures disclosed herein are formed of an assembly of multiple stacked monolithic refractory slabs forming respective tiers of the corbel.

BACKGROUND

Coke ovens traditionally comprise massive refractory brick structures in which there are batteries of adjacent parallel walls made up from a large variety of differently shaped refractory bricks. The bricks must be able to withstand high temperatures and strong mechanical loading. At the same time, the interior of the walls contains flue ducts, burners, flue gas control passages, fuel gas passages, combustion gas passages and the like. The detailed design of the oven is usually quite complicated in order to obtain the necessary heat distribution within the oven and gas flows through the walls.

It follows from the above that coke ovens are relatively costly structures and any downtime for servicing and repairs can represent a significant economic loss for an operator.

Further, the production of ceramic bricks from which the walls are made is relatively costly and there is accordingly a need to generally reduce the number of different types of bricks which are used in a wall.

U.S. Pat. Nos. 6,066,236, 8,266,853 and 8,640,635 as well as U.S. Patent Application Publication Nos. 2016/0281983 and 2016/0264870 (the entire contents of each such patent and published patent application being expressly incorporated hereinto by reference) have proposed that relatively large-sized monolithic refractory blocks may be assembled to form the corbel structures of coke ovens. In general, the assembly of such large-sized monolithic refractory blocks enables the coke ovens to be constructed and/or repaired with much less production down time.

While such prior proposals for coke oven corbel structures are satisfactory for their intended purpose, continual improvements are sought. It is towards providing such improvements that the embodiments disclosed herein are directed.

SUMMARY

The coke oven corbel structures of the embodiments disclosed herein include an assembly of a multiple number of stacked refractory slabs defining a corresponding multiple number of tiers of the corbel structure, wherein the multiple number of stacked refractory slabs define a pair of substantially vertically oriented central fuel gas passageways and pairs of combustion air passageways laterally of a respective one of the central fuel gas passageways. A plurality of vertically stacked fuel gas blocks each defining a central fuel gas conduit may be positioned within each of the central fuel gas passageways.

According to certain embodiments, each of the combustion air passageways may comprise an inclined segment between a bottom opening and a top opening thereof. In such embodiments, at least one of the combustion air passageways may include a vertically oriented segment in at least one of the slabs. According to other embodiments, at least two of the slabs define vertically oriented segments of at least one of the combustion air passageways.

At least one of the slabs may define a pair of elongate parallel grooves in an upper surface thereof and a pair of elongate tongues protruding from a bottom surface thereof so as to mate with respectively corresponding pairs of elongate tongues and grooves formed in superjacent and subjacent slabs in the stack.

At least a plurality of the slabs in the stack may partially define an additional combustion air passageway associated with an adjacent flue of the coke oven. A stacked plurality of edge blocks may optionally be provided at side edges of at least a plurality of slabs in the stack. Additionally or alternatively, at least one of the slabs in the stack may comprise a finger element protruding from one end thereof.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

Figure 1:
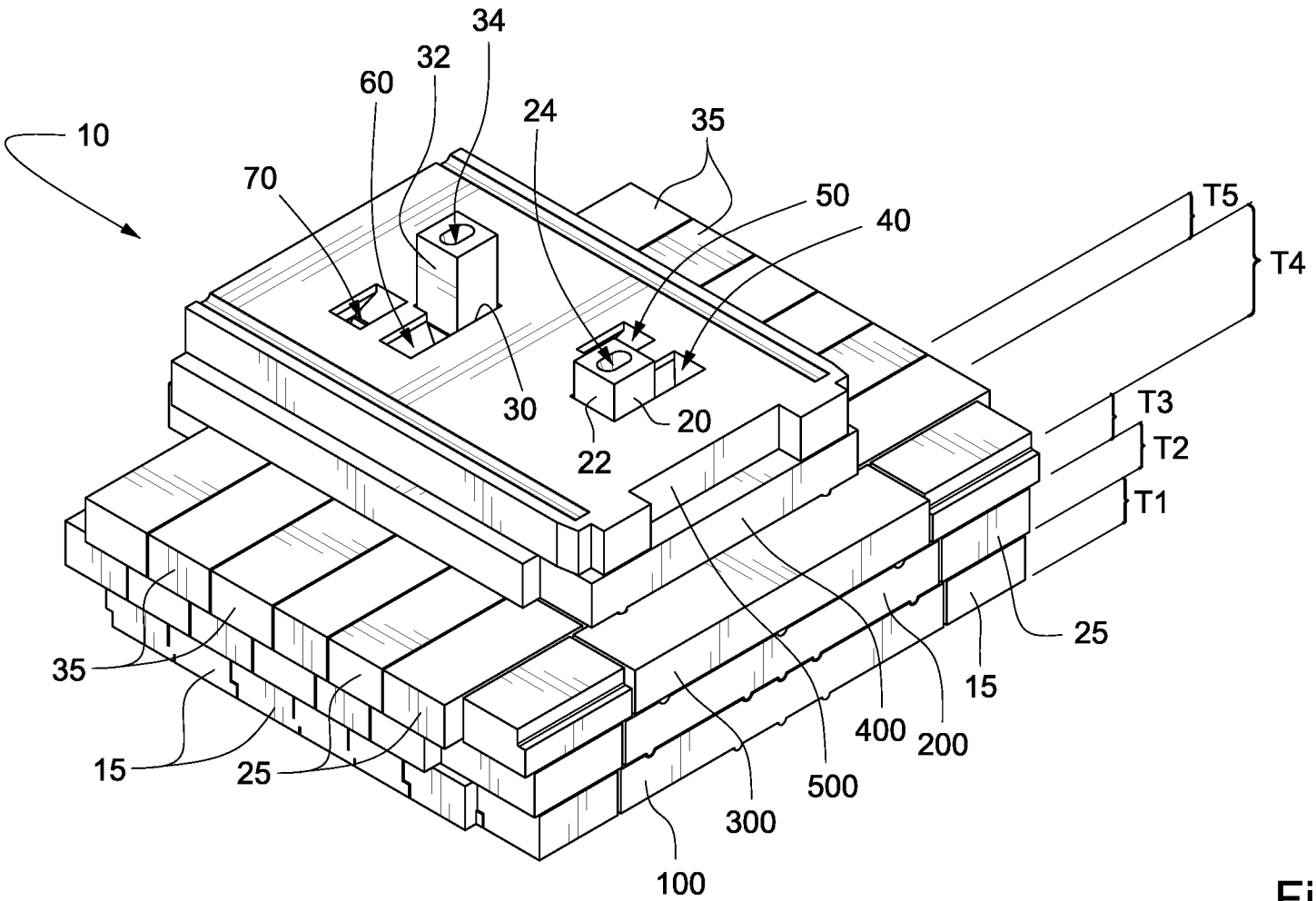
FIG. 1 is a perspective view showing an exemplary stacked slab coke oven corbel structure adapted to servicing an adjacent pair of flues in a coke oven in accordance with an embodiment of the present invention.
Figure 2:
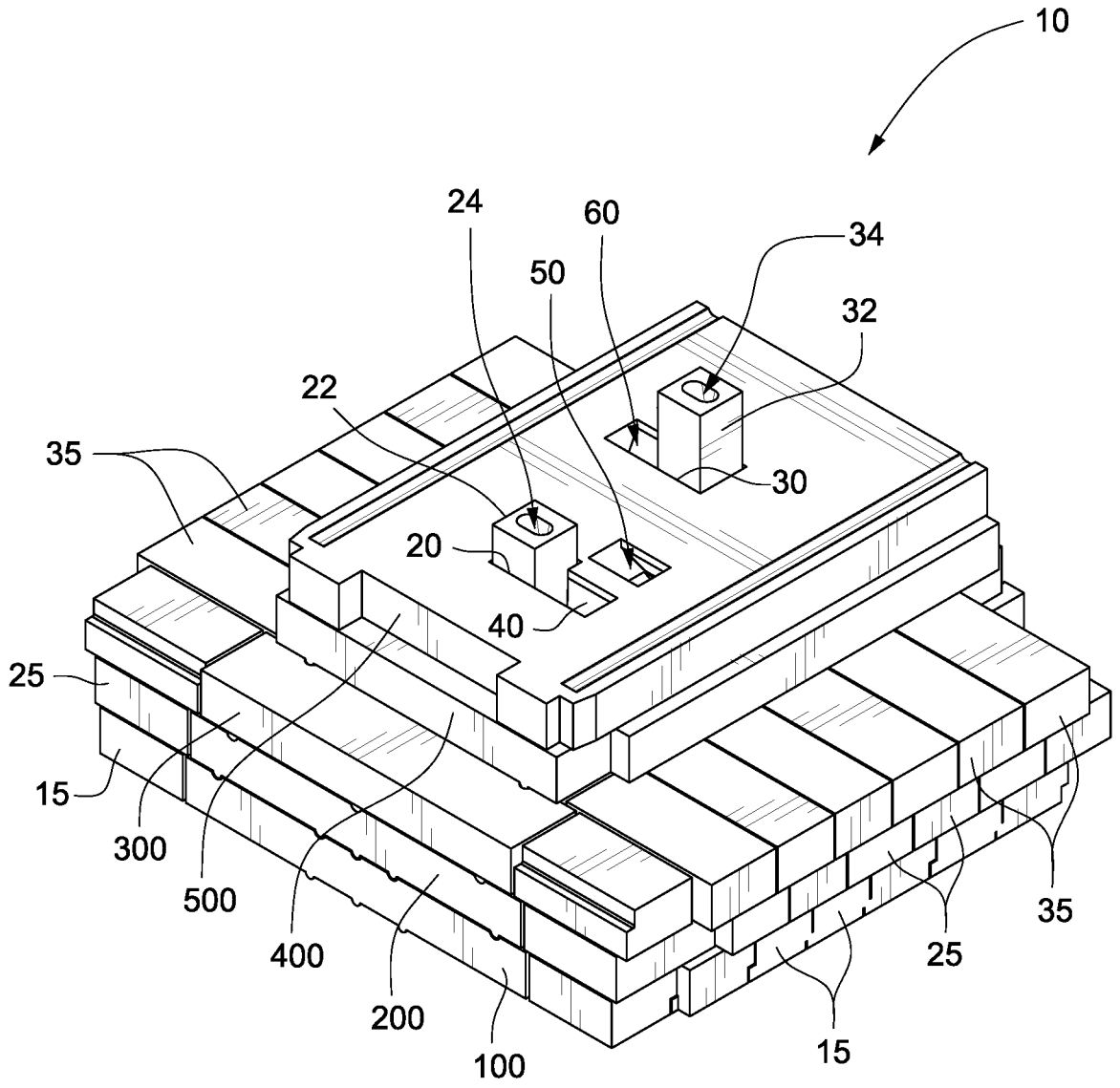
FIG. 2 is a right front perspective view of thereof.
Figure 3:
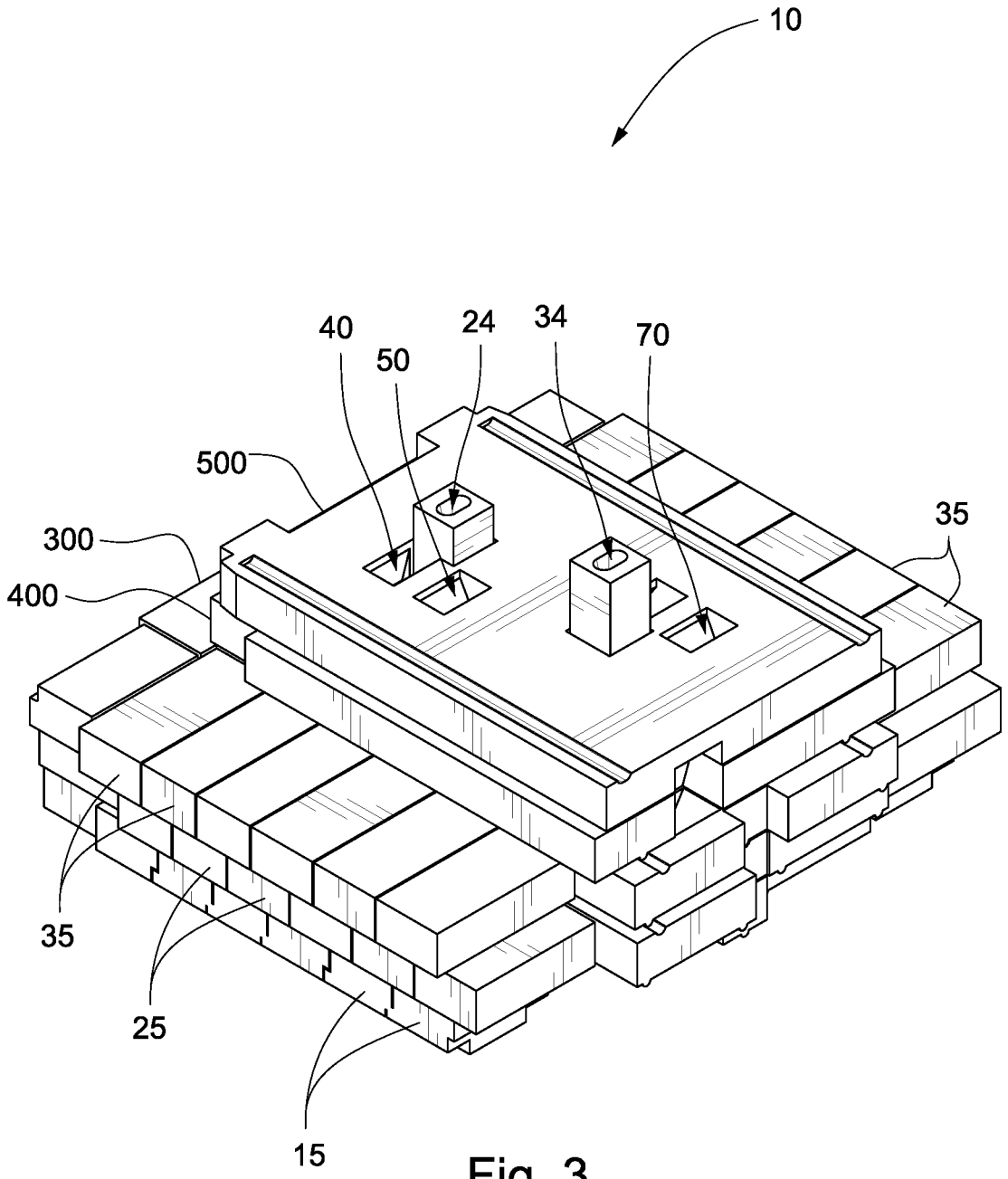
FIG. 3 is a right rear perspective view thereof.
Figure 4:
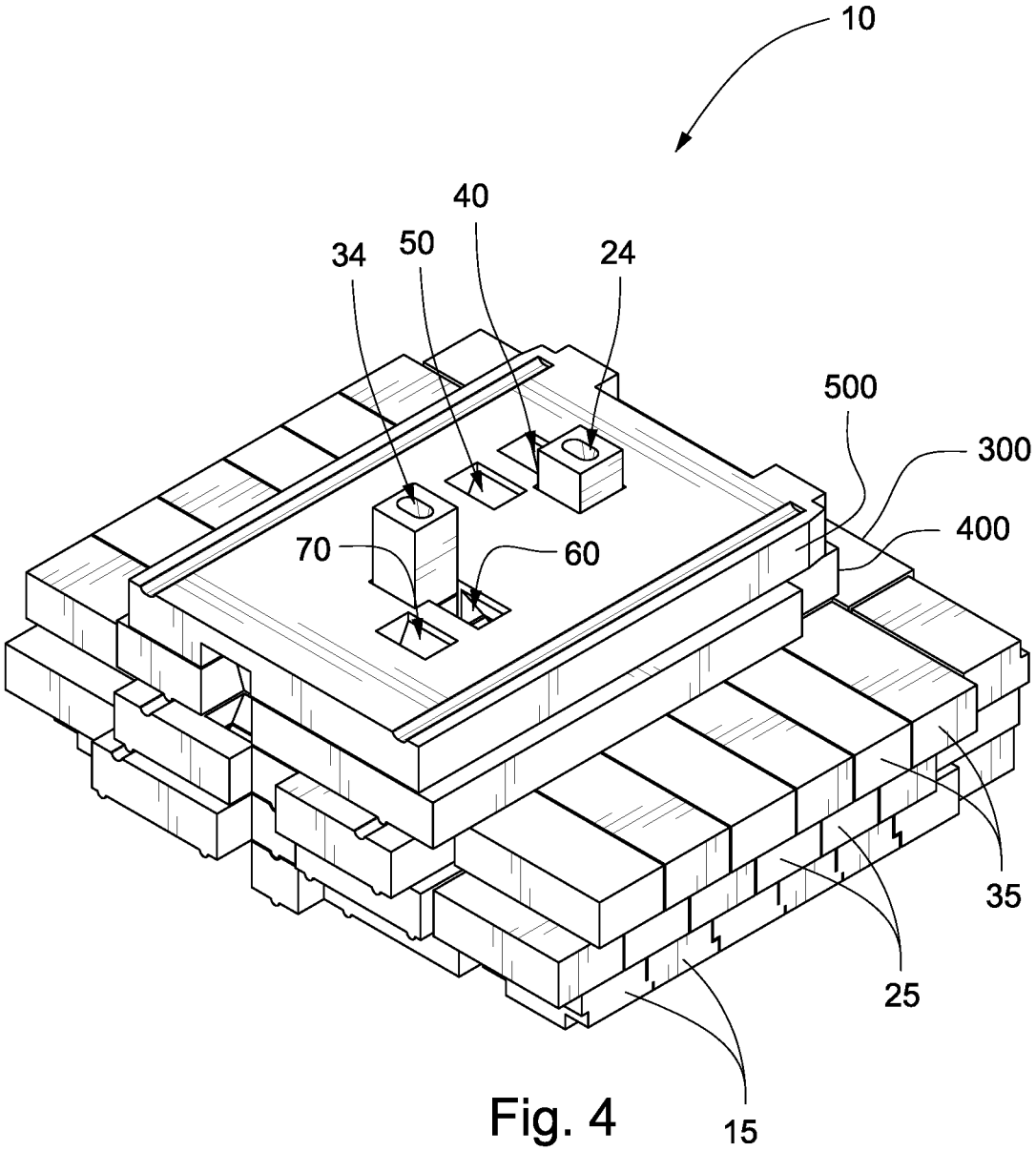
FIG. 4 is a left rear perspective view thereof.
Figure 5:
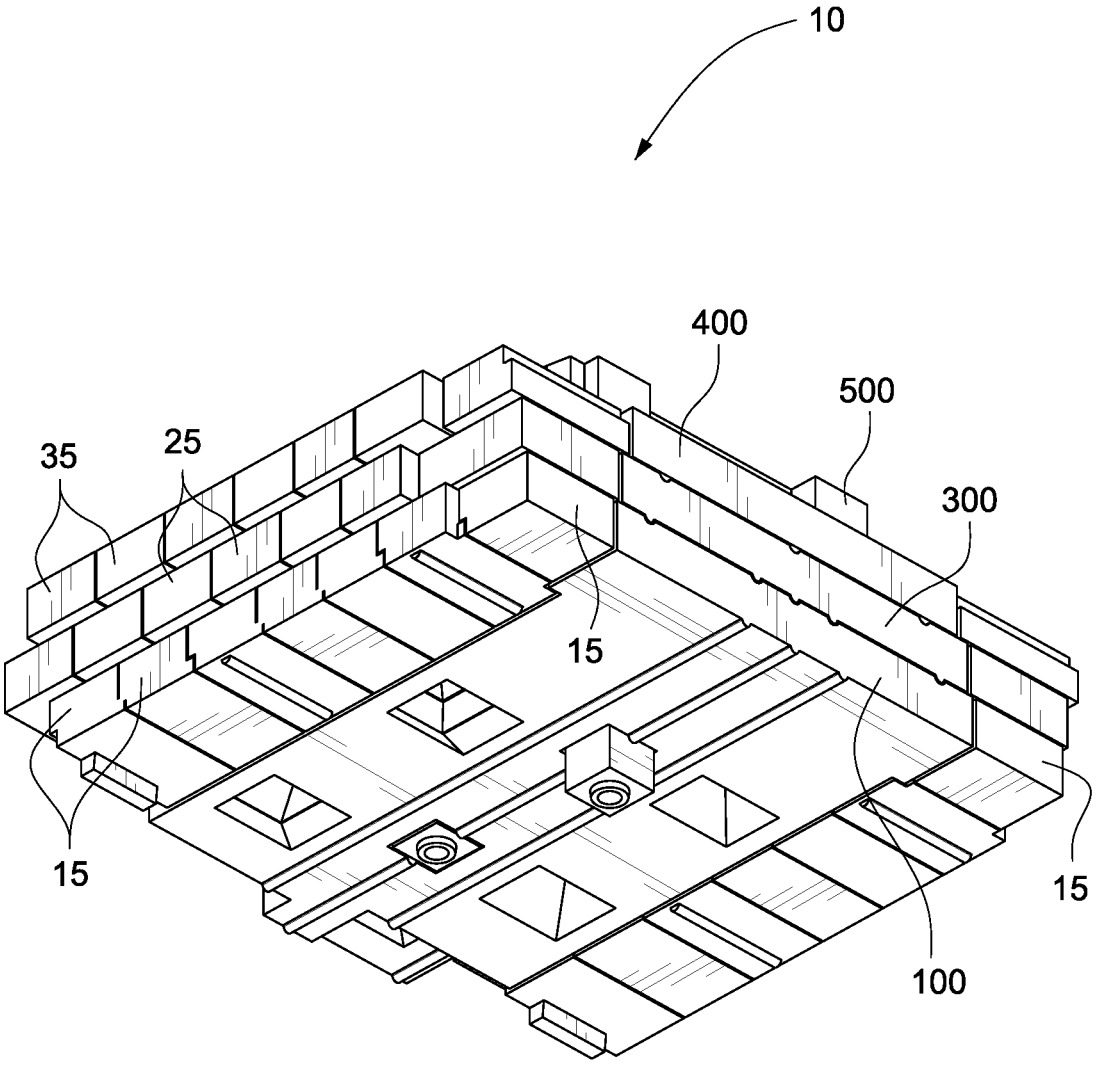
FIG. 5 is a bottom perspective view thereof.
Figure 6:
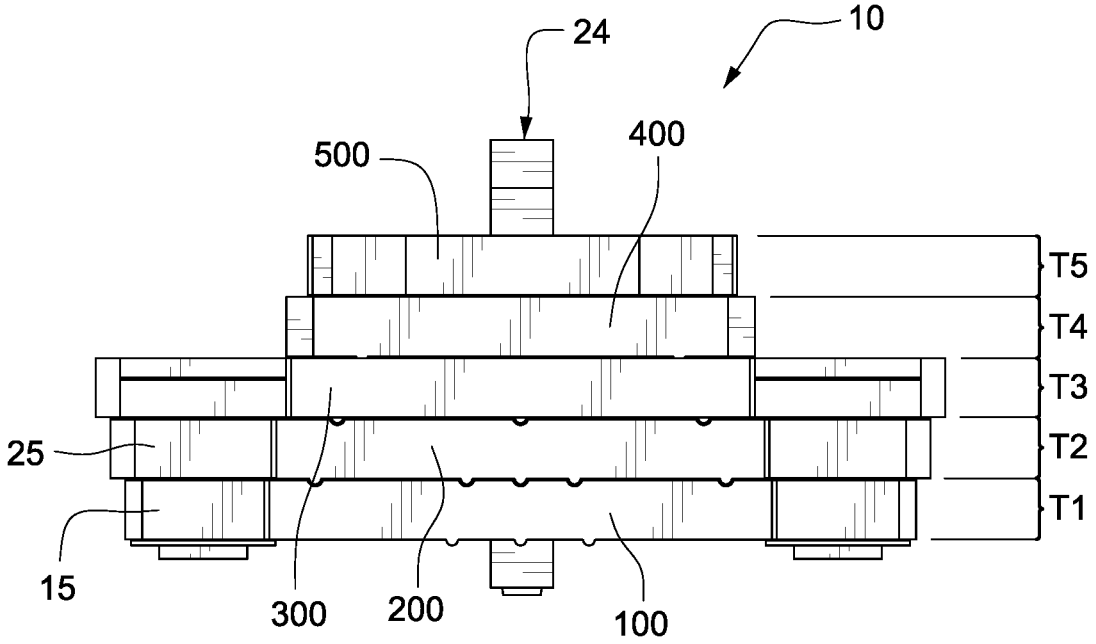
FIG. 6 is a front end elevation view thereof.
Figure 7:
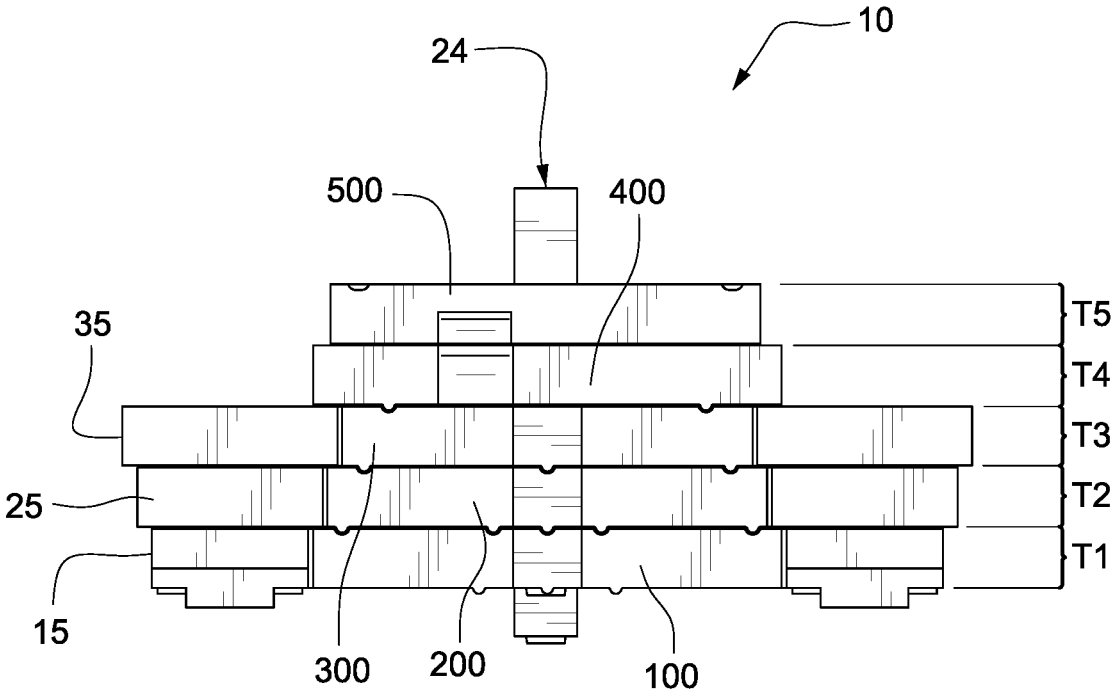
FIG. 7 is a rear end elevation view thereof.
Figure 8:
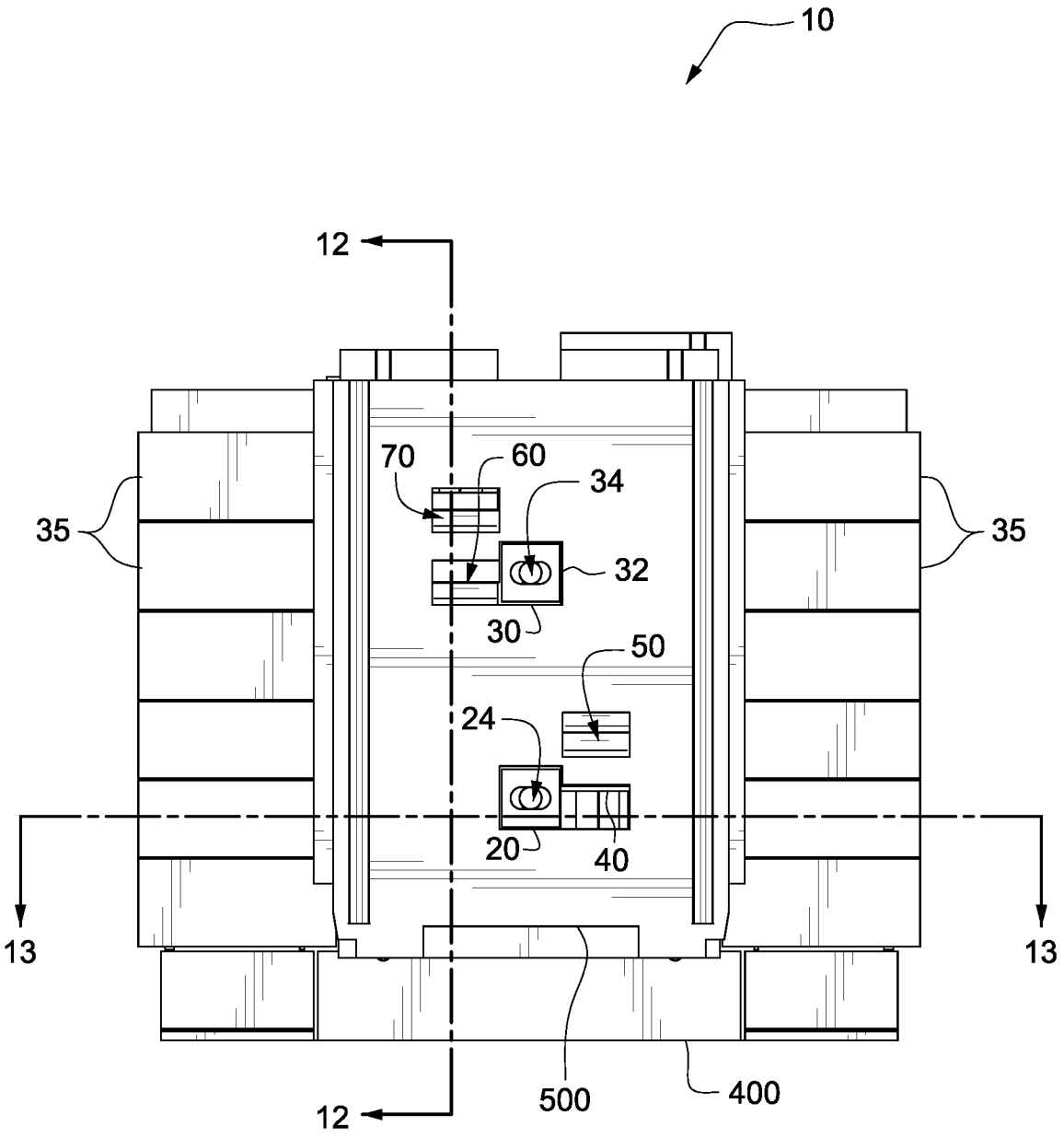
FIG. 8 is a top plan view thereof.
Figure 9:
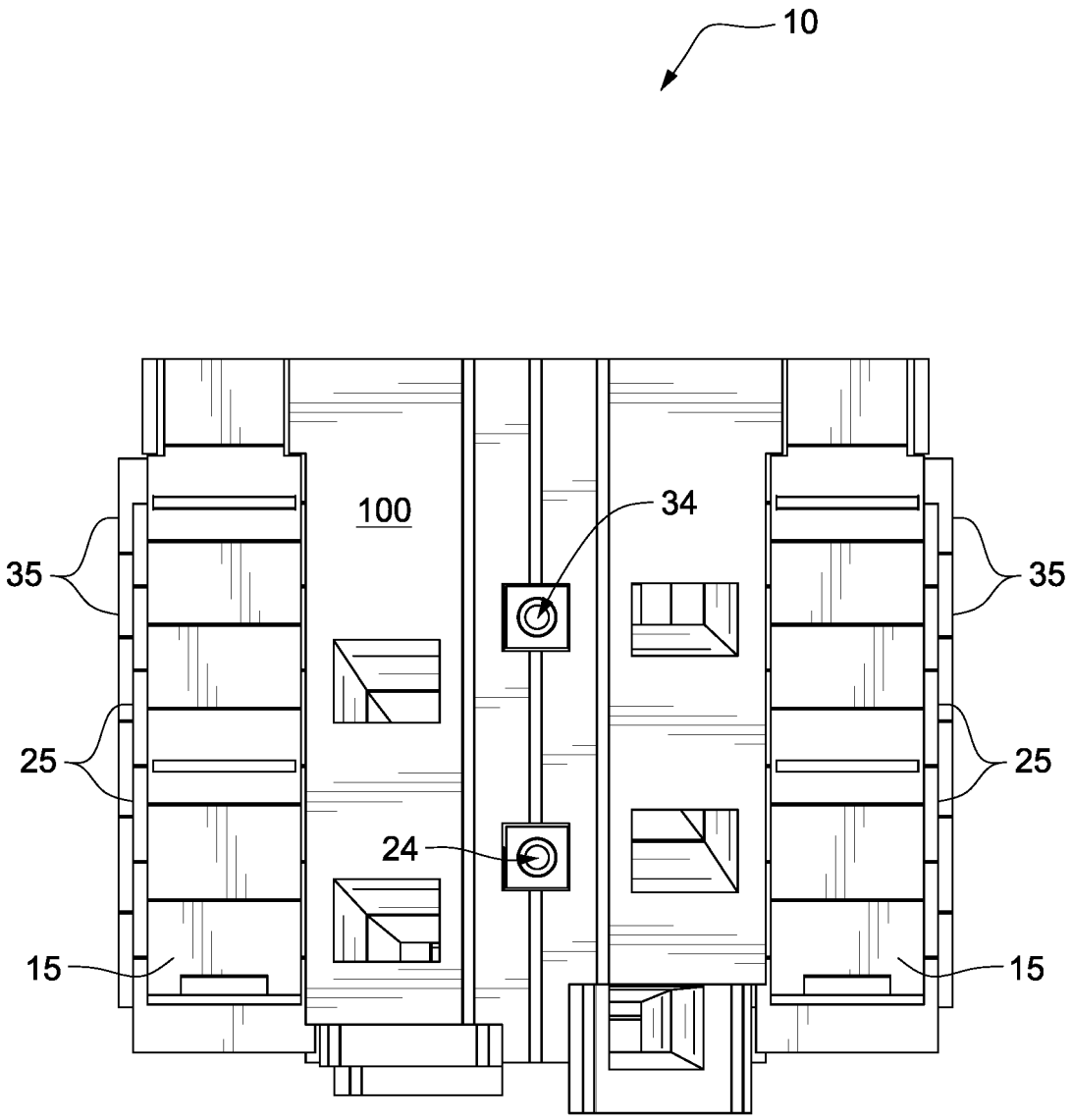
FIG. 9 is a bottom plan view thereof.
Figure 10:
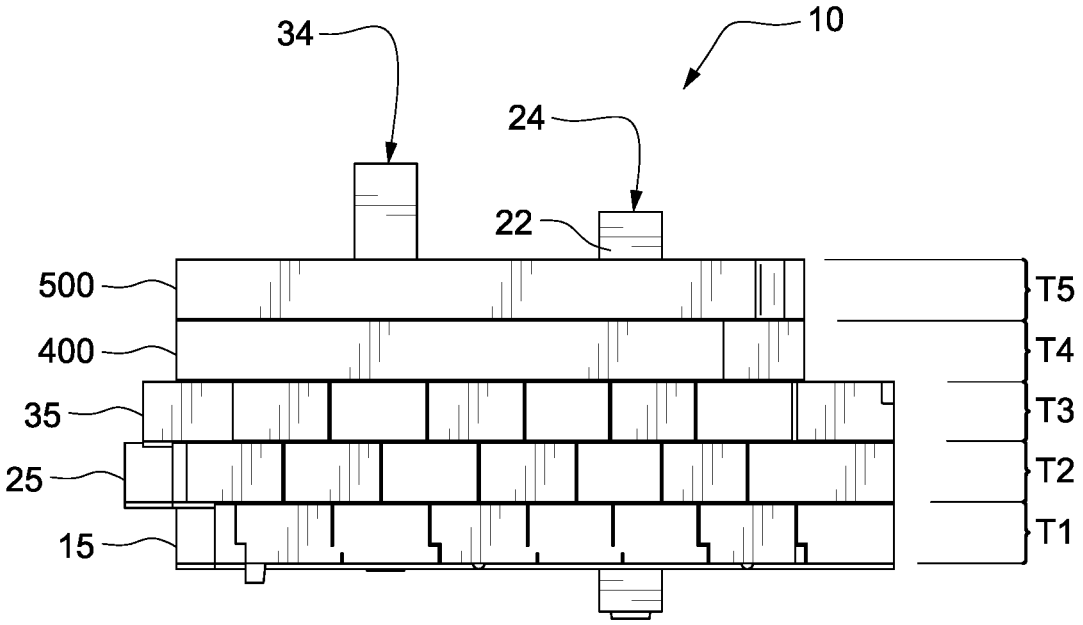
FIG. 10 is a left side elevation view thereof.
Figure 11:
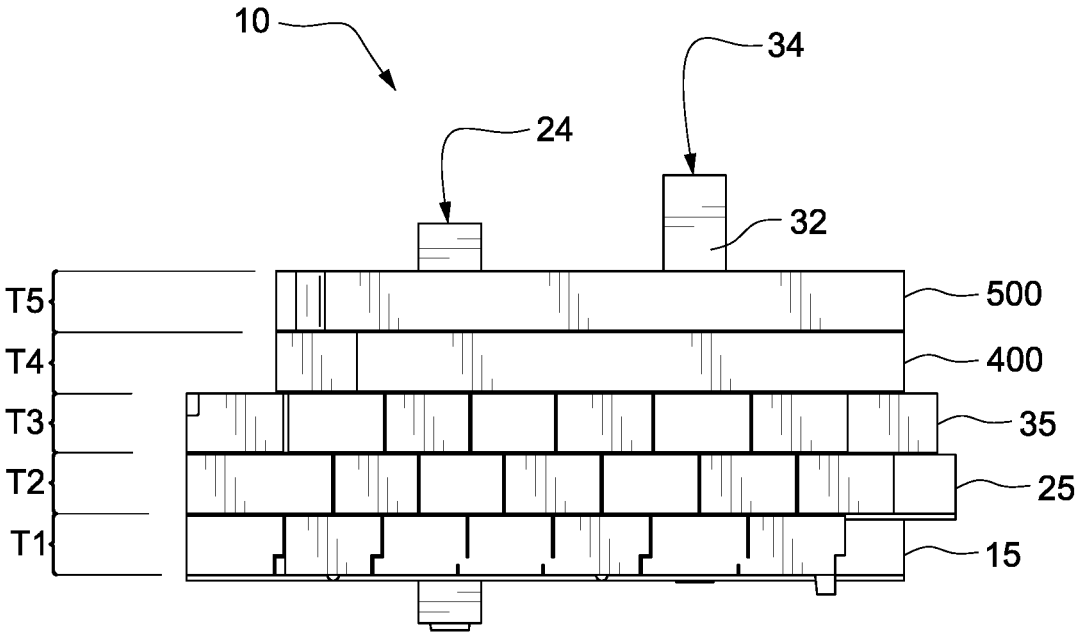
FIG. 11 is a right side elevation view thereof.
Figure 12:
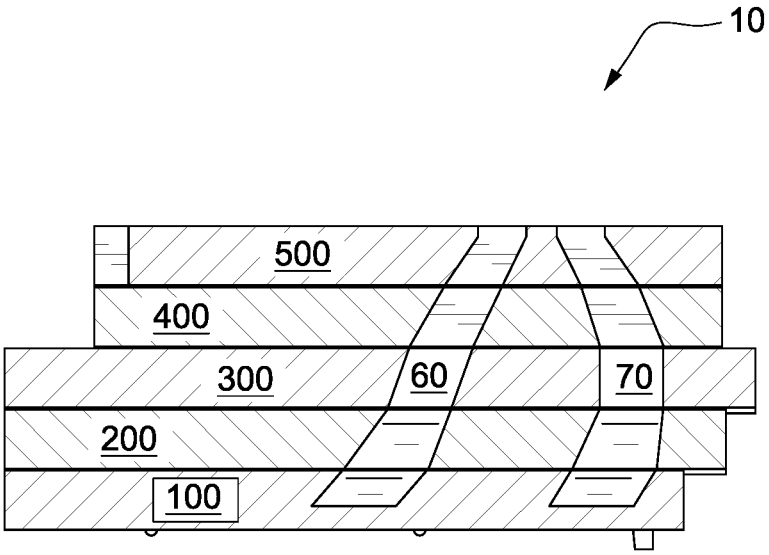
FIG. 12 is a cross-sectional elevation view thereof as taken along line 12-12 in FIG. 8.
Figure 13:
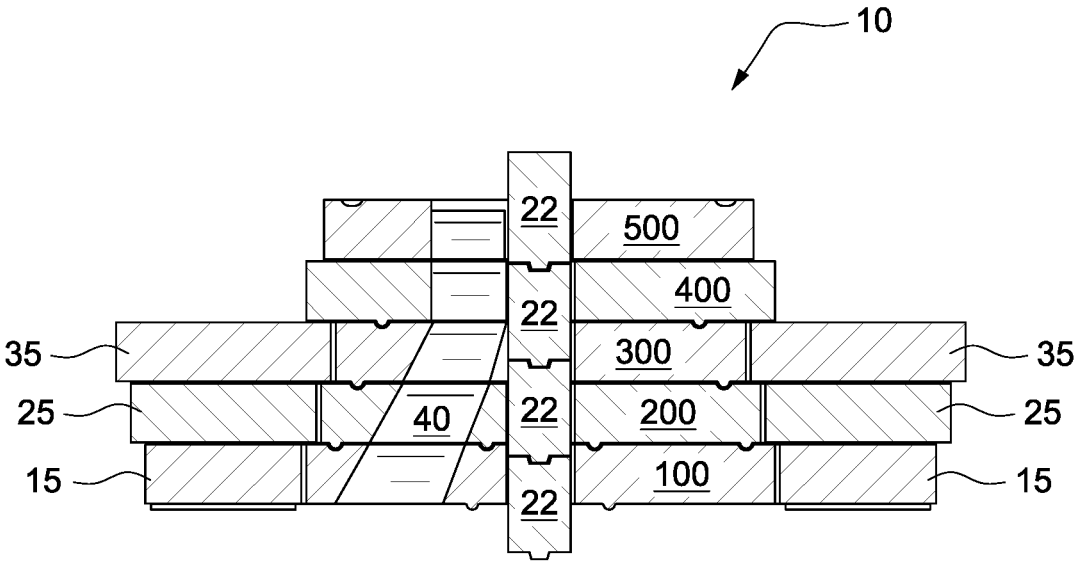
FIG. 13 is a cross-sectional elevation view thereof as taken along line 13-13 in FIG. 8.
Figure 14:
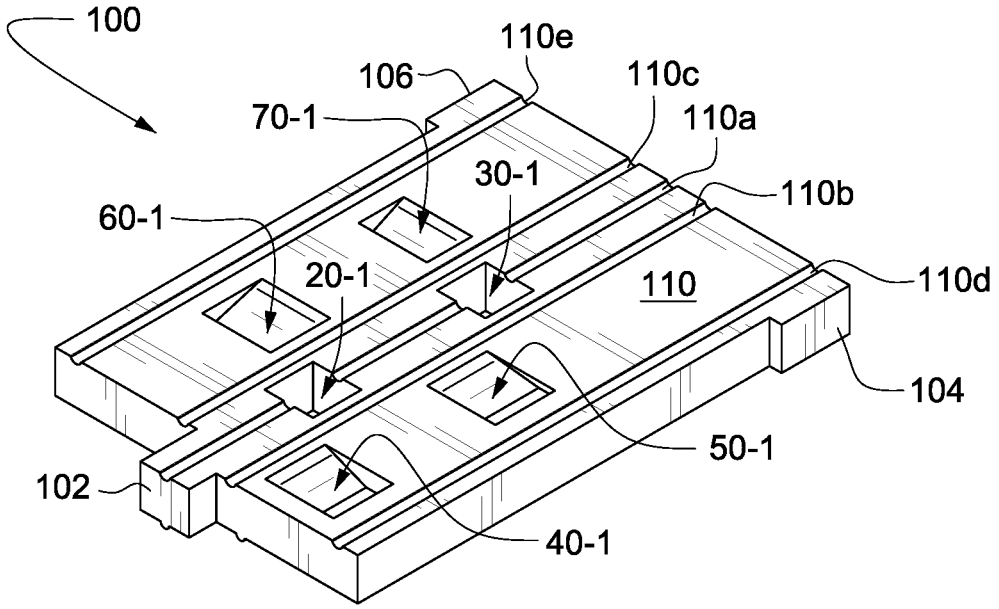
Figure 15:
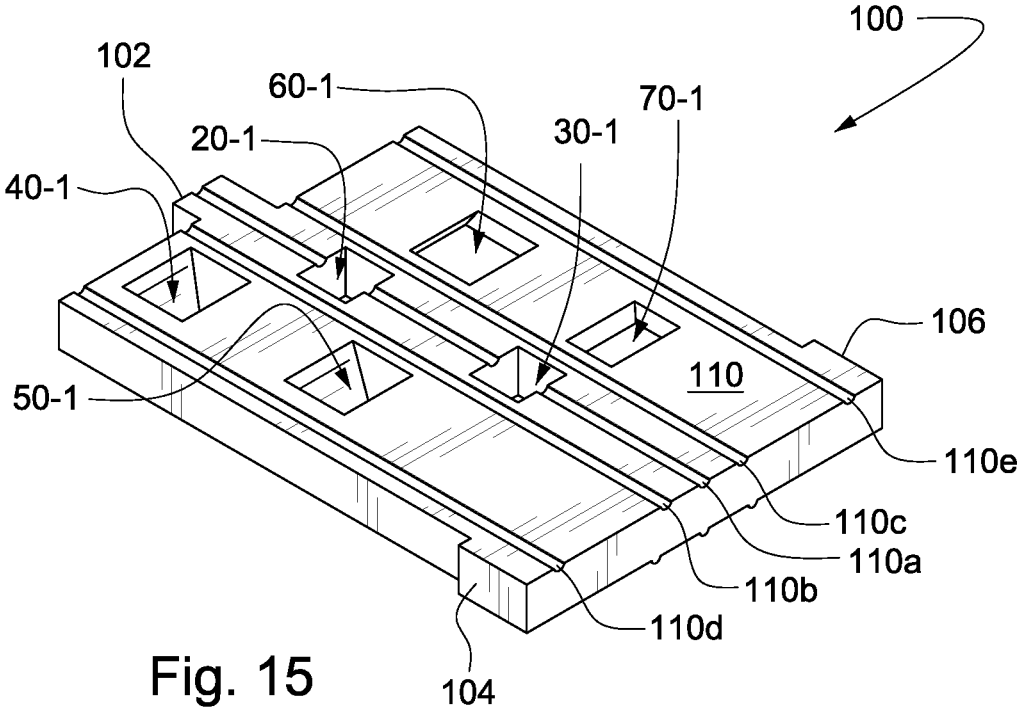
Figure 16:
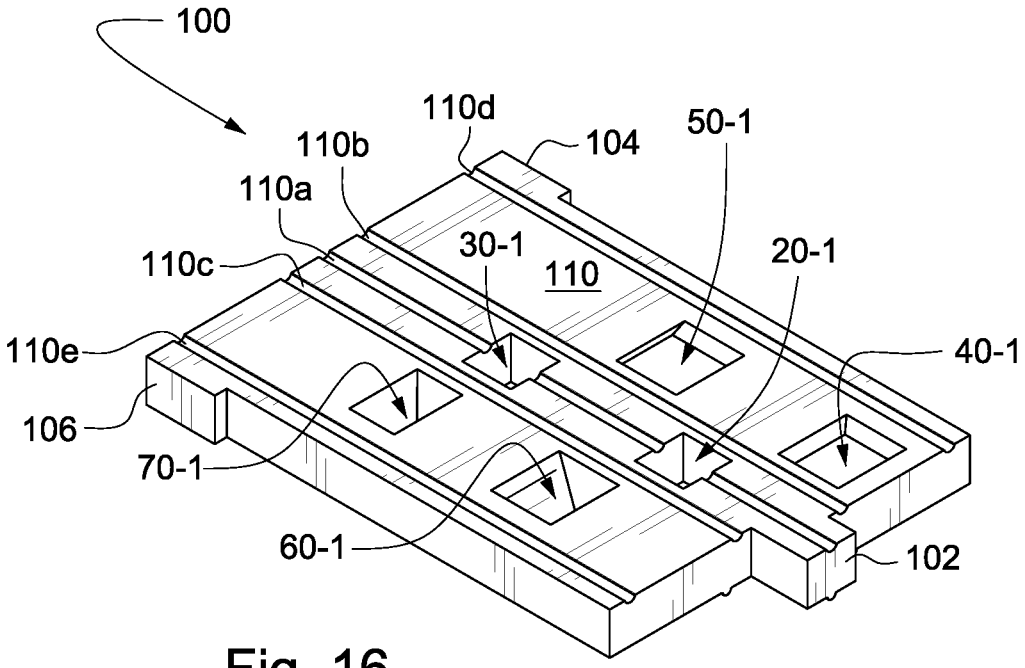
Figure 17:
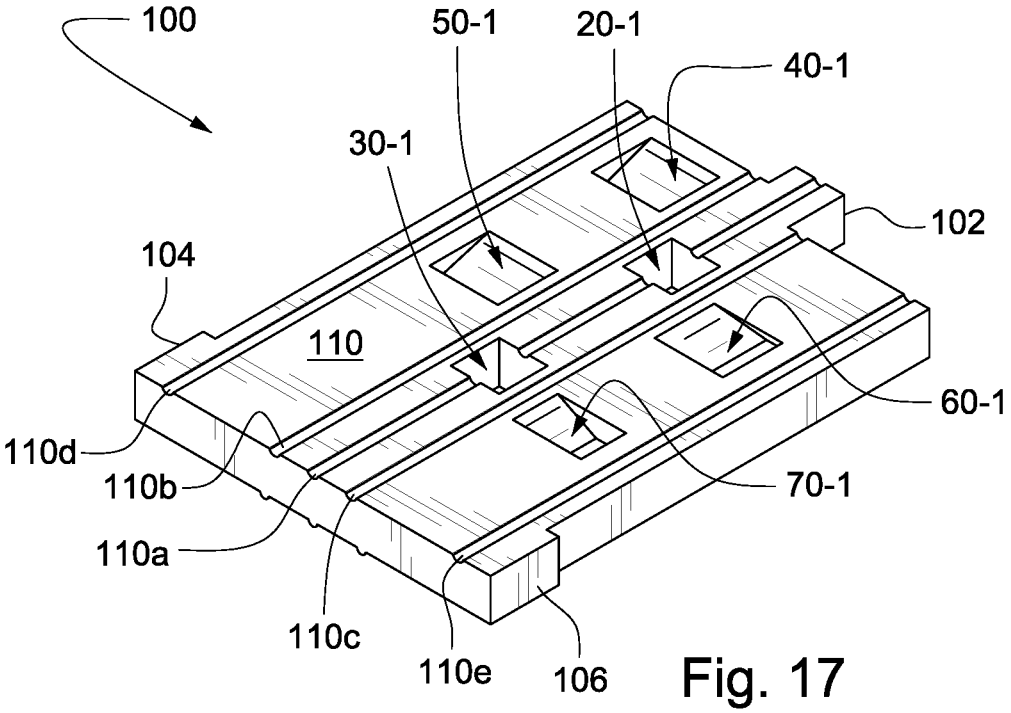
Figure 18:
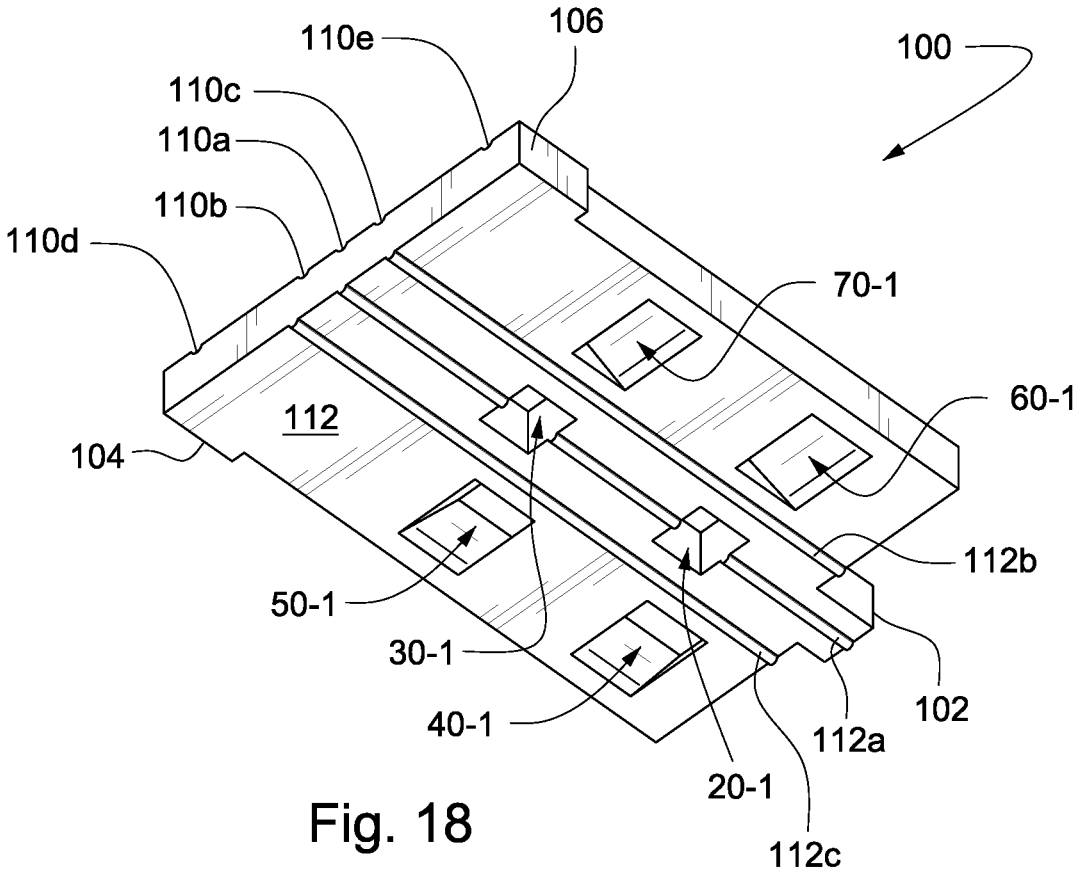
Figure 19:
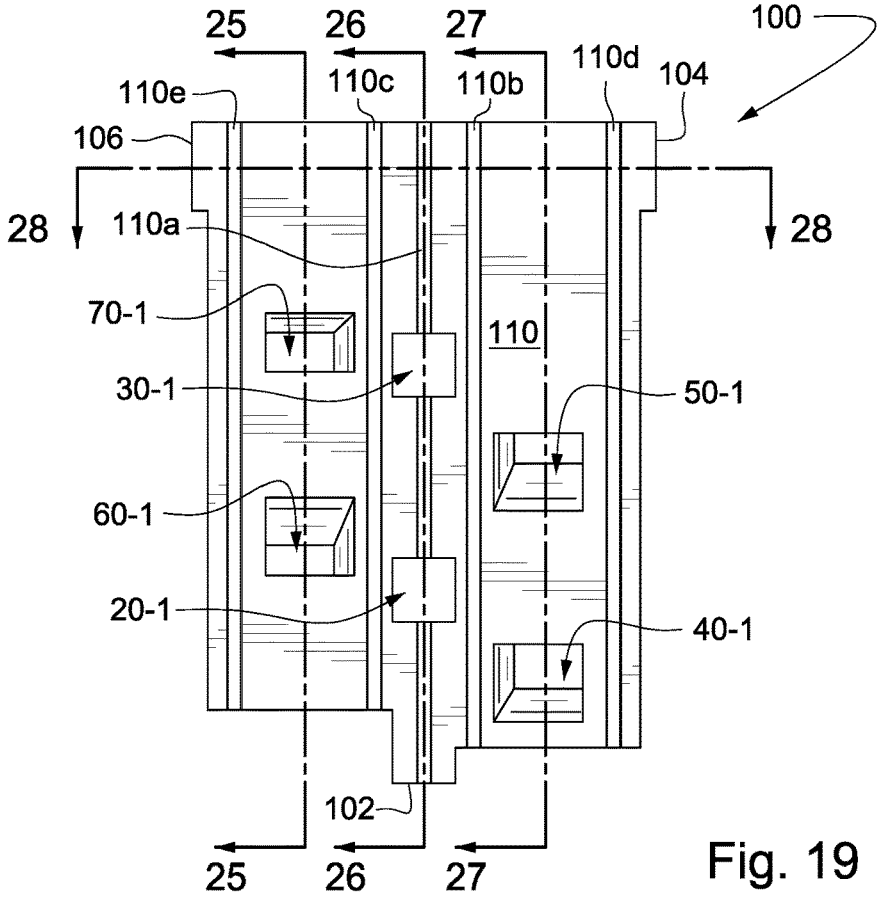
Figure 20:
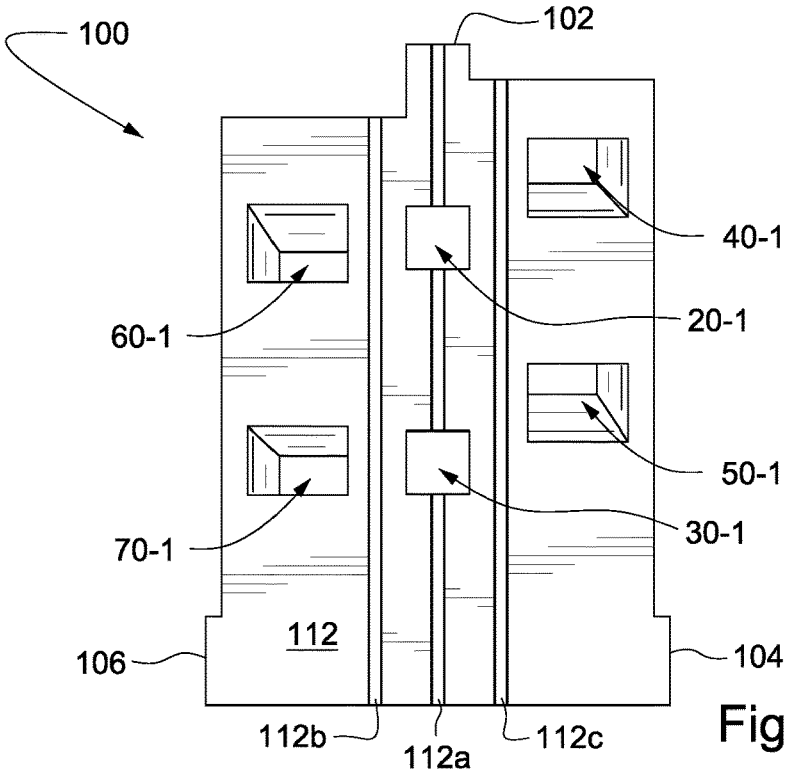
Figure 21:
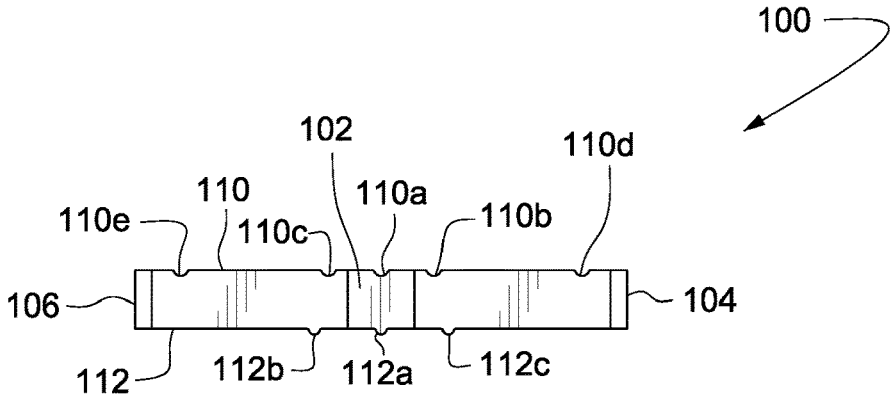
Figure 22:
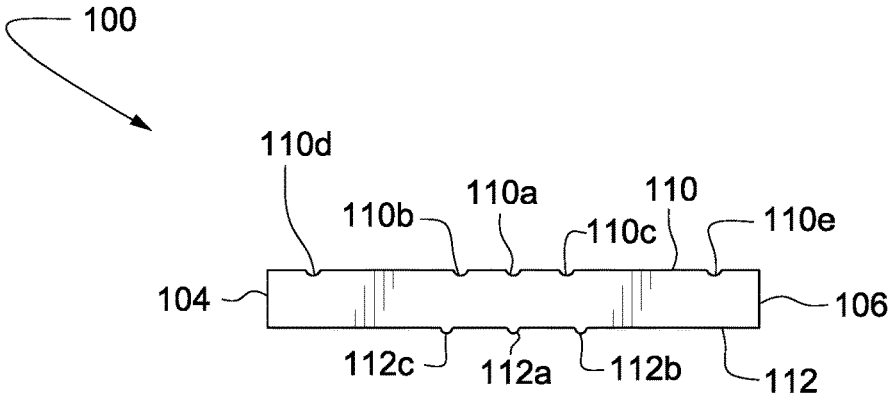
Figure 23:
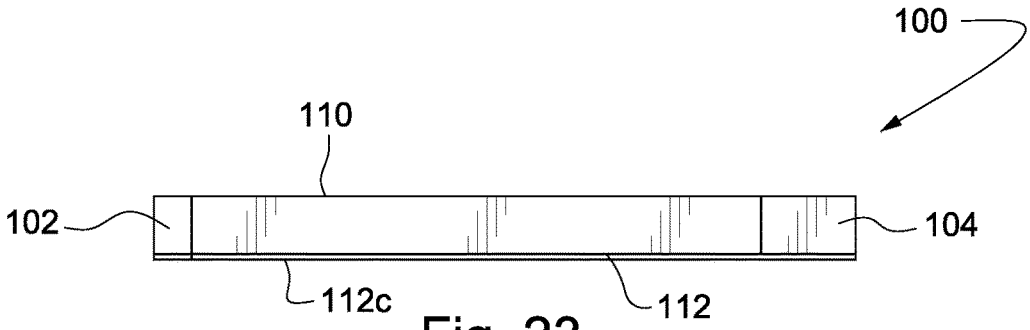
Figure 24:
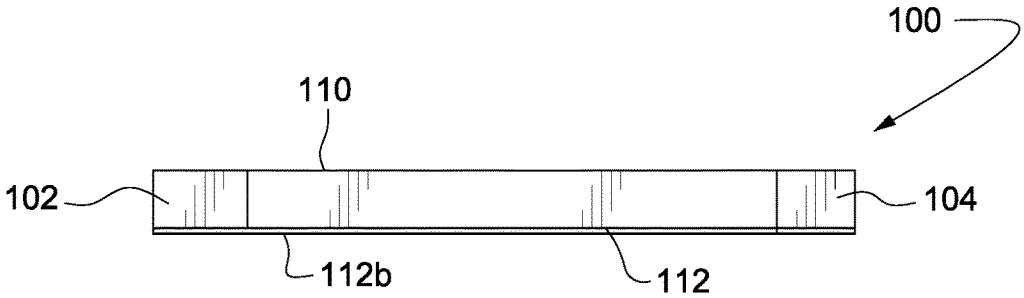
Figure 25:
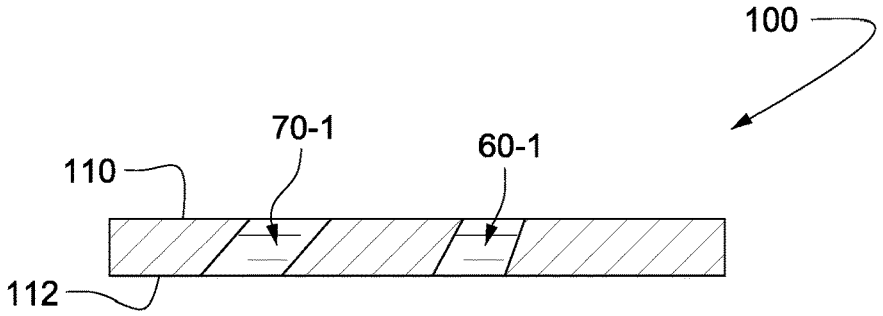
Figure 26:
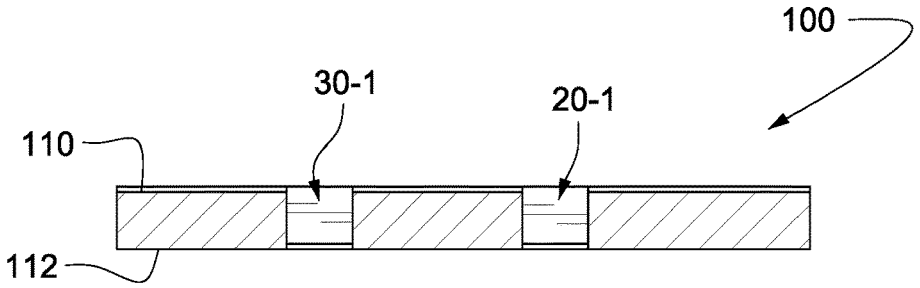
Figure 27:
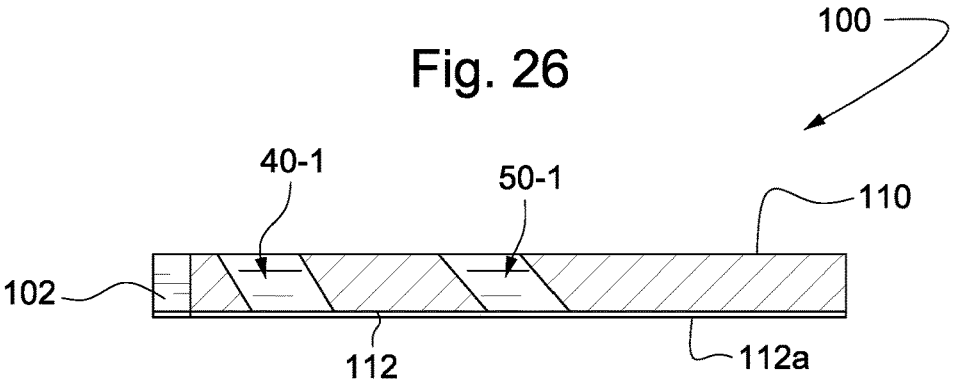
Figure 28:
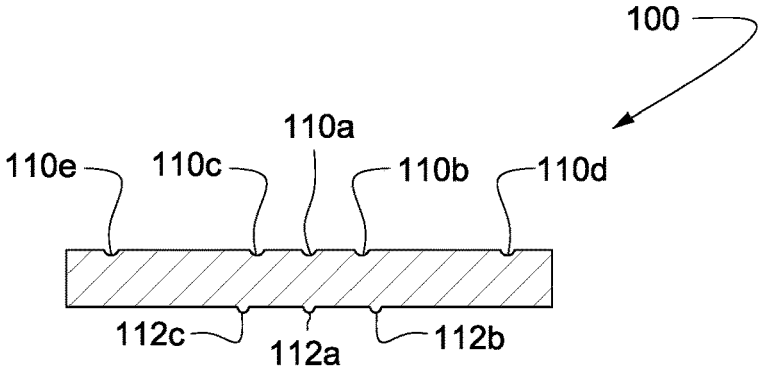
Figure 29:
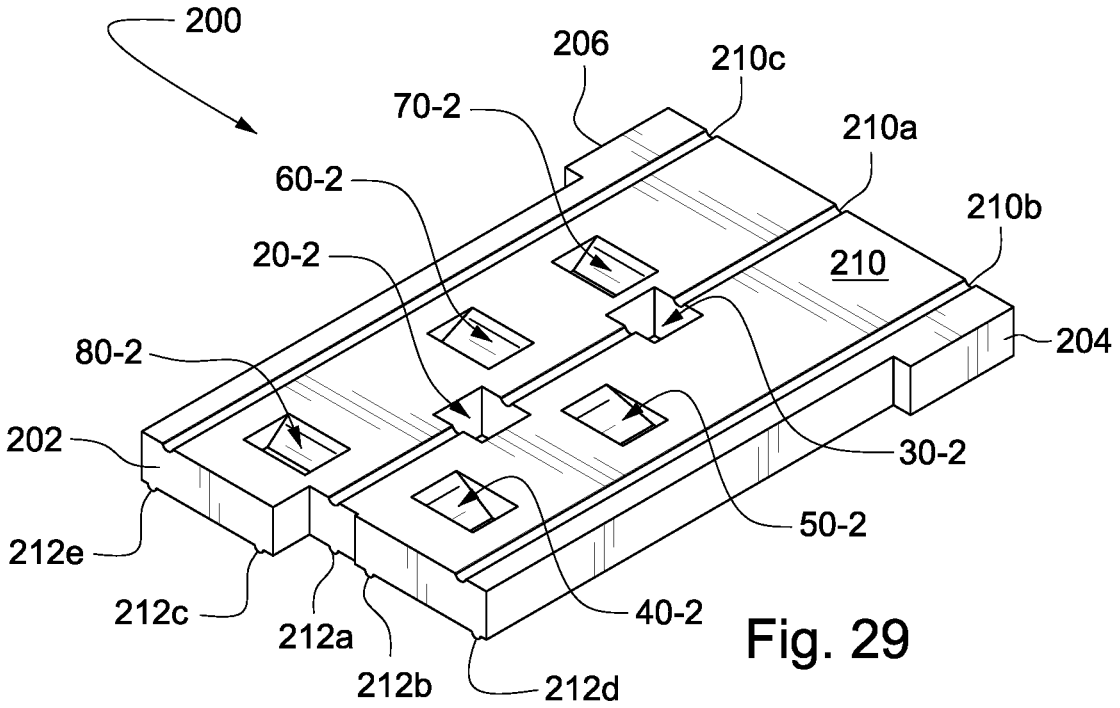
Figure 30:
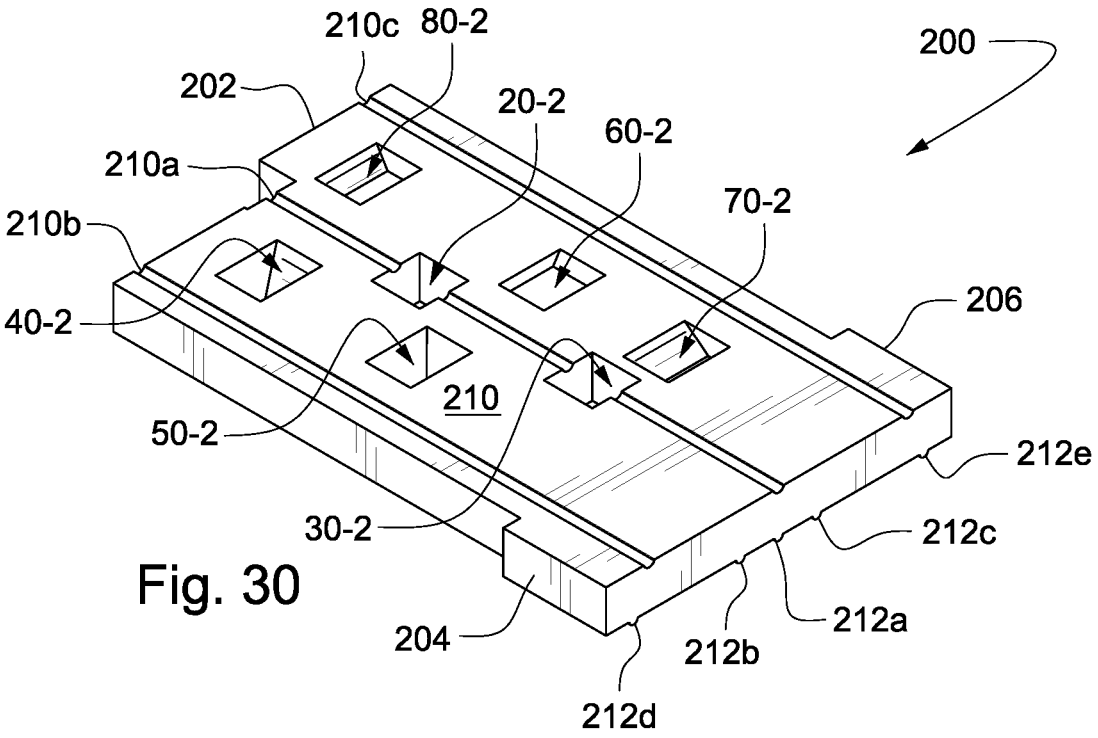
Figure 31:
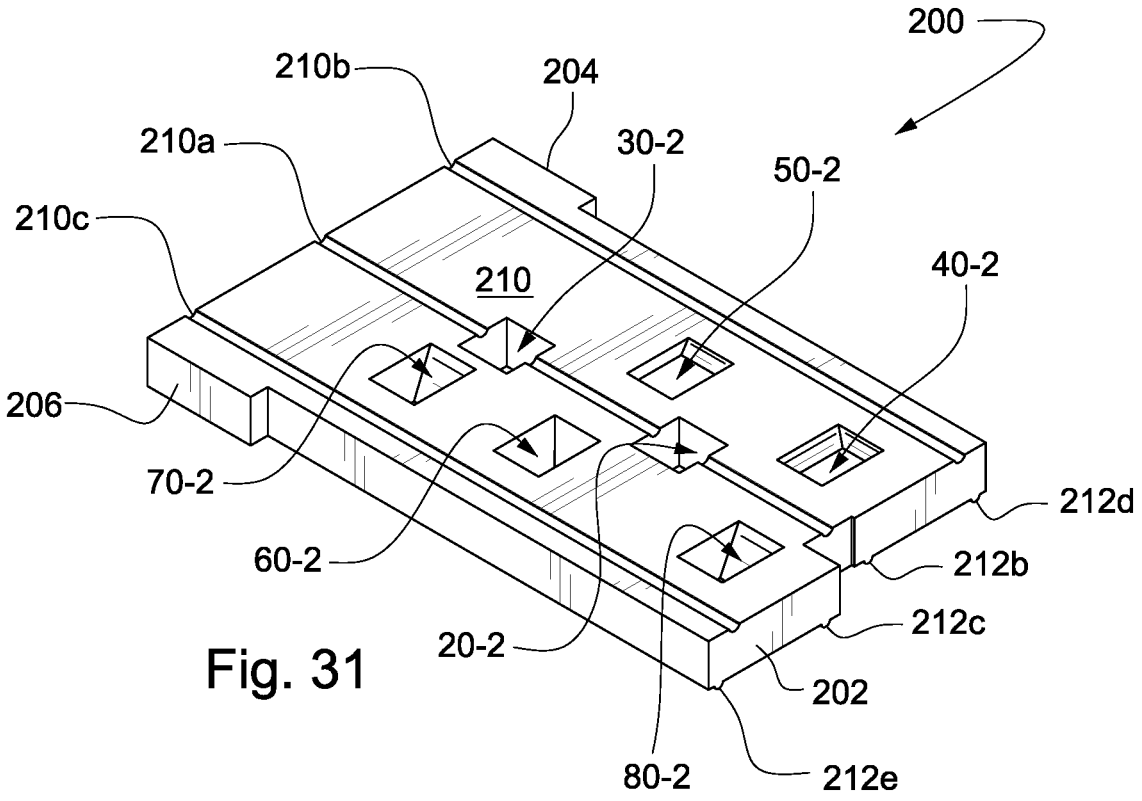
Figure 32:
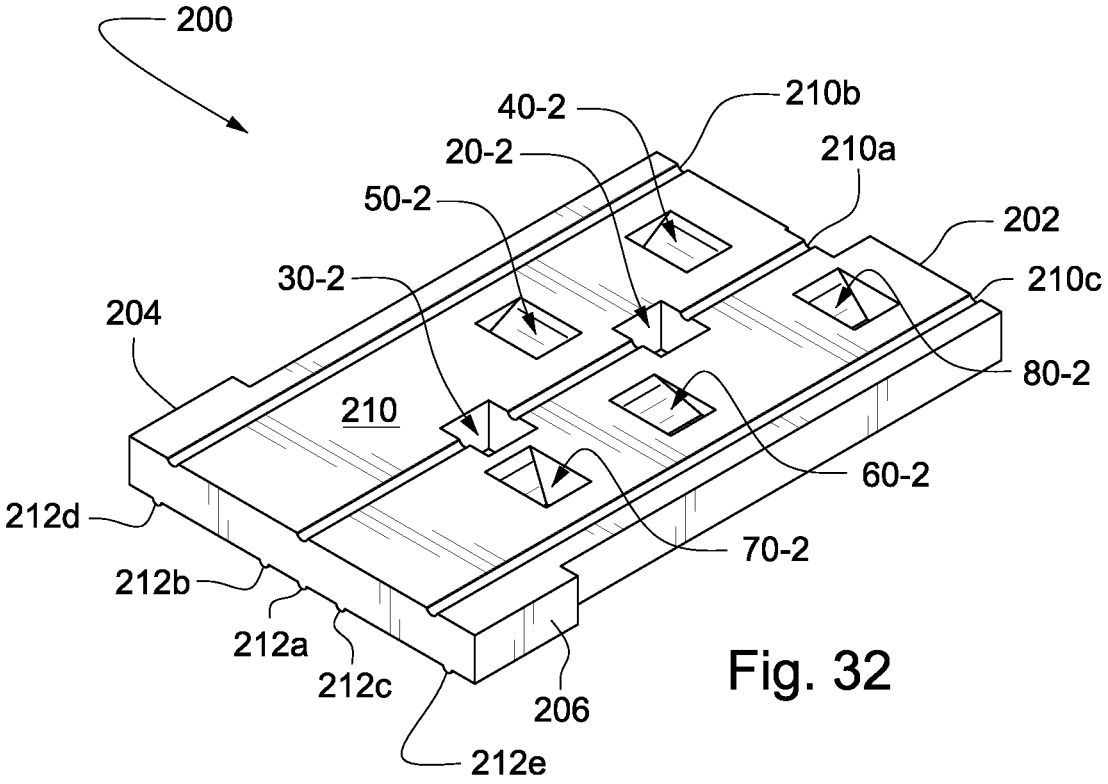
Figure 33:
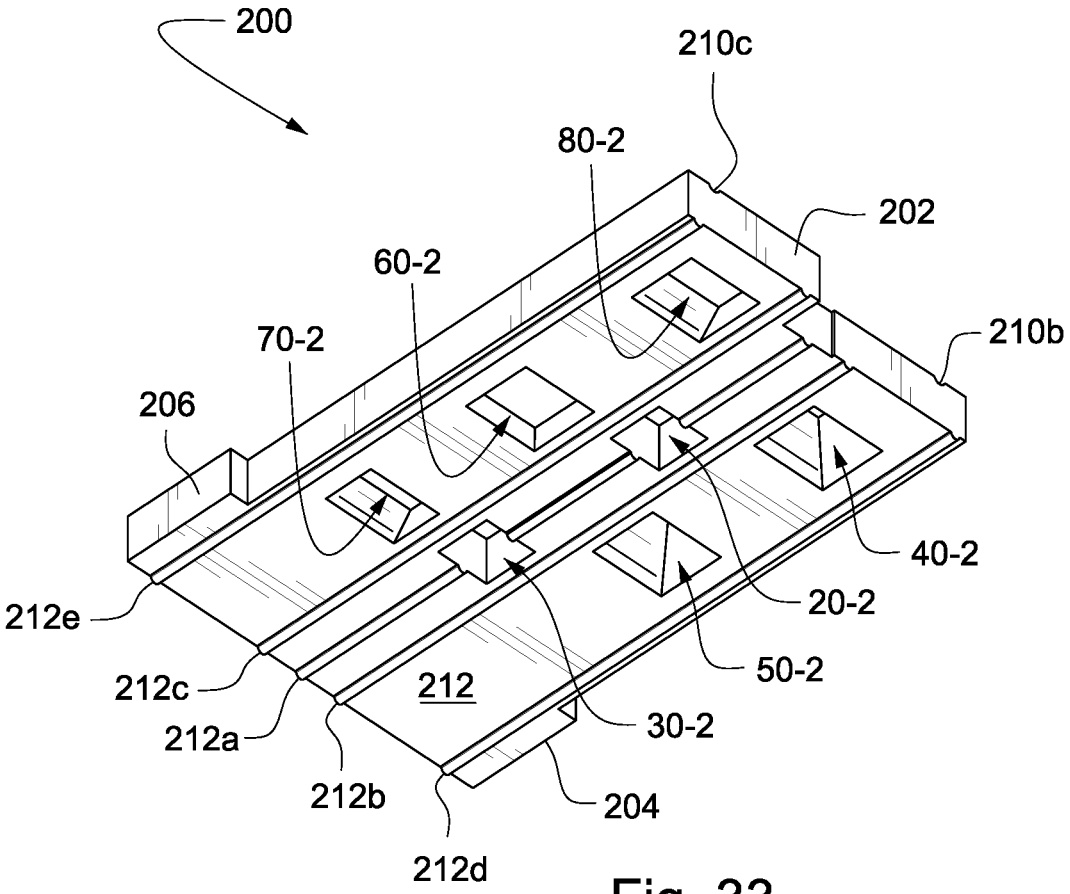
Figure 34:
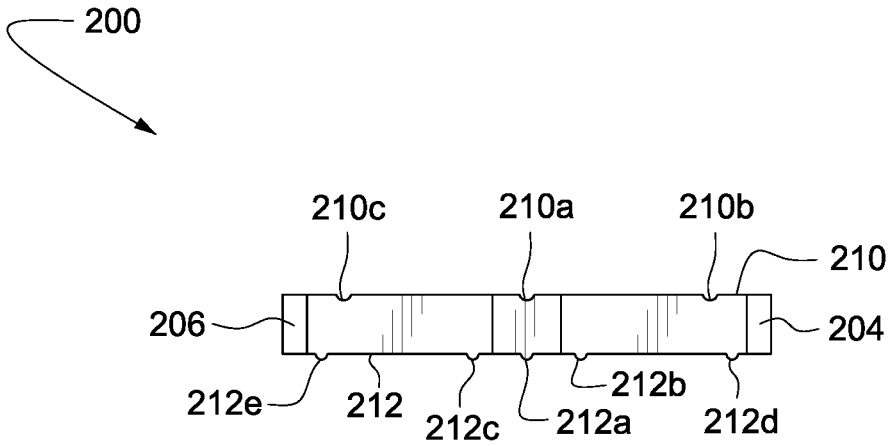
Figure 35:
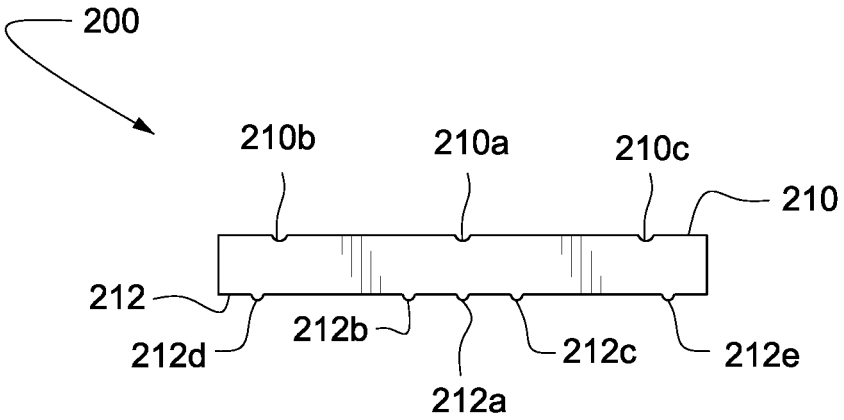
Figure 36:
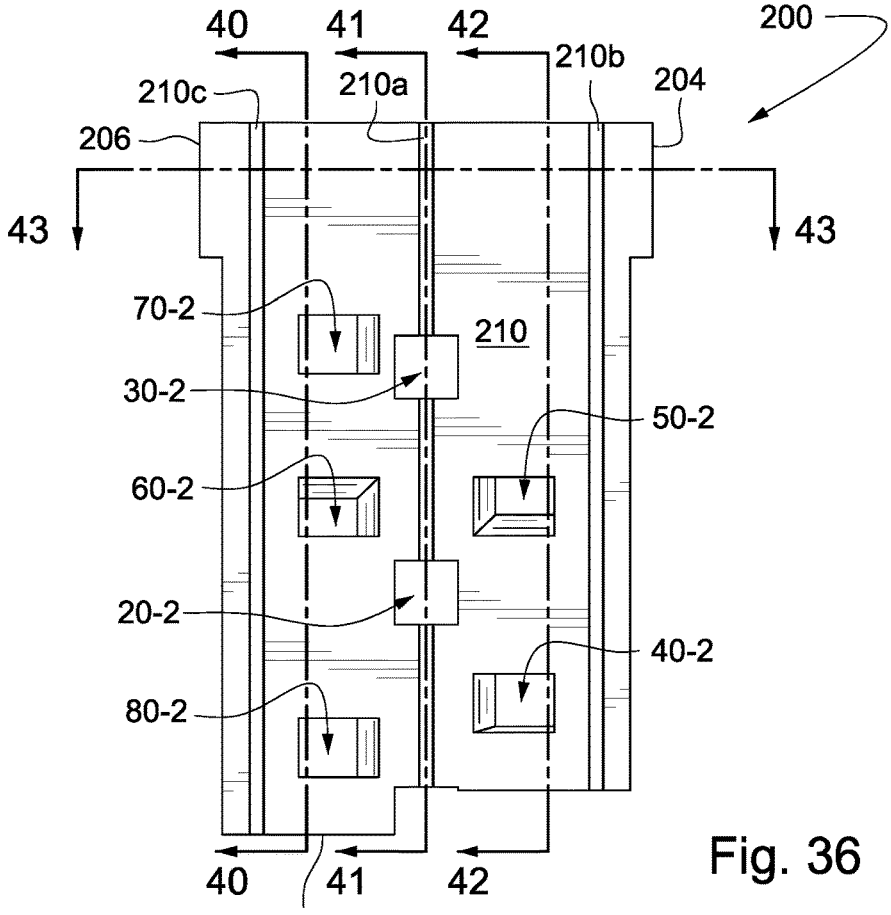
Figure 37:
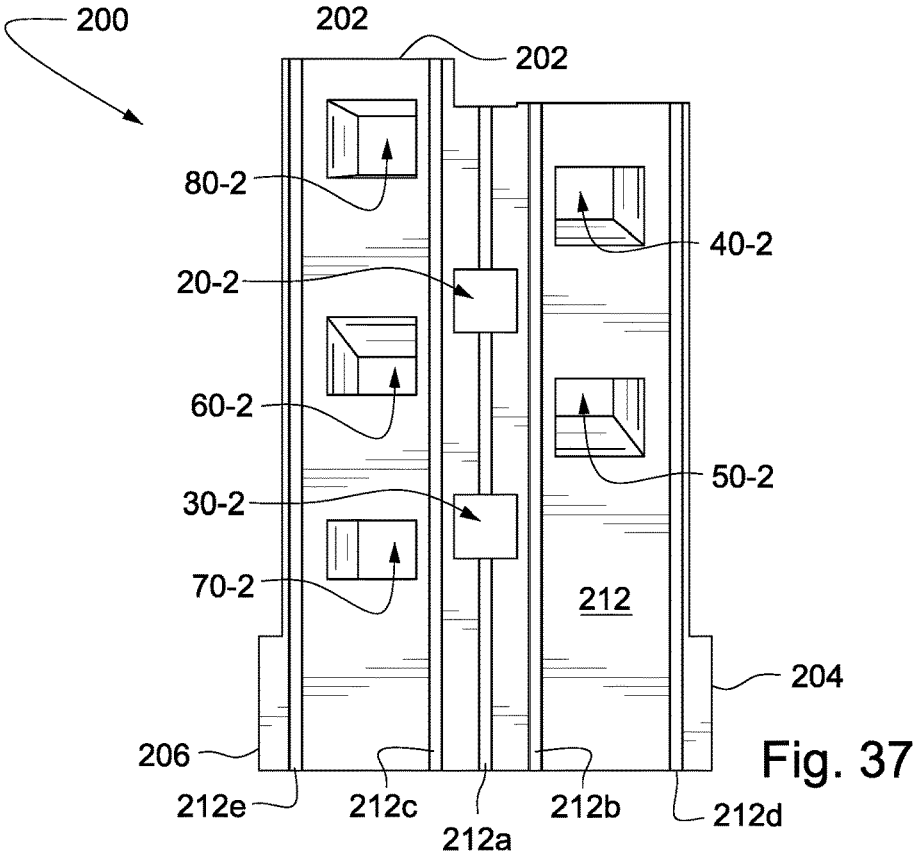
Figure 38:
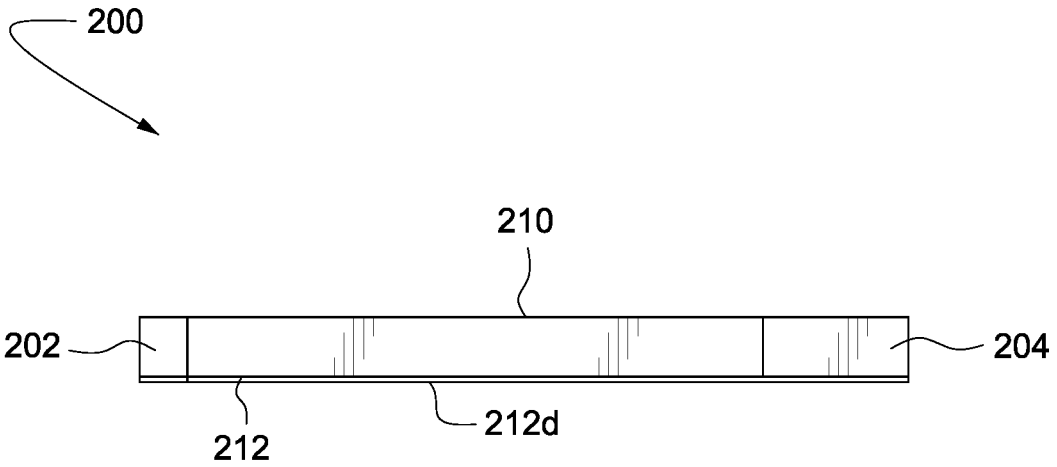
Figure 39:
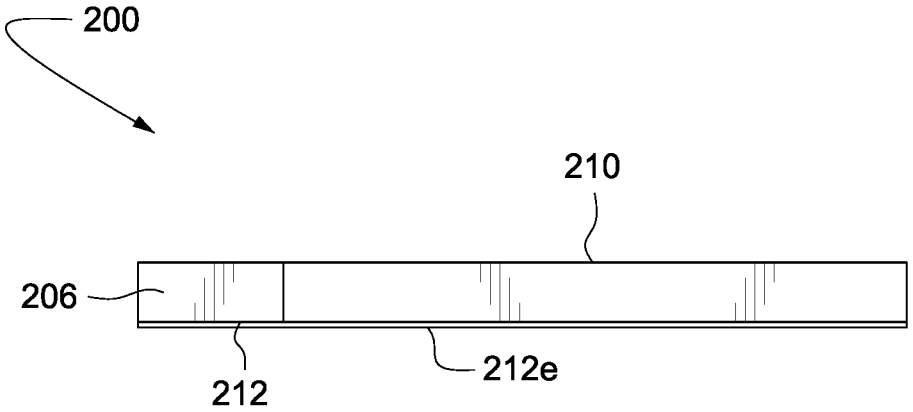
Figure 40:
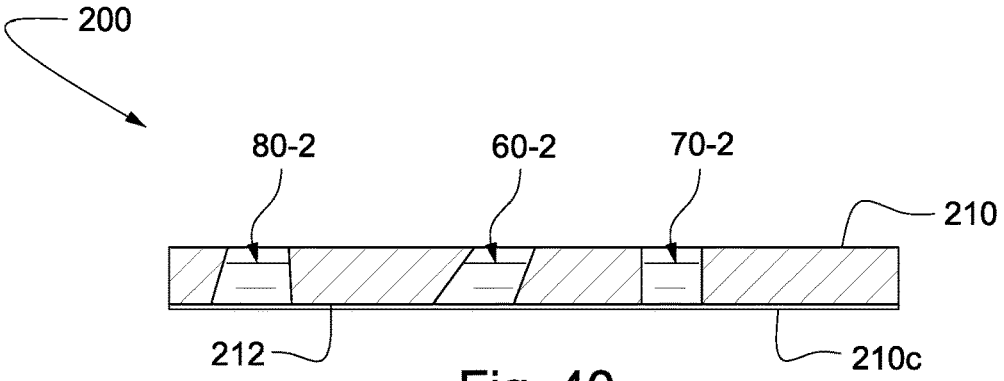
Figure 41:
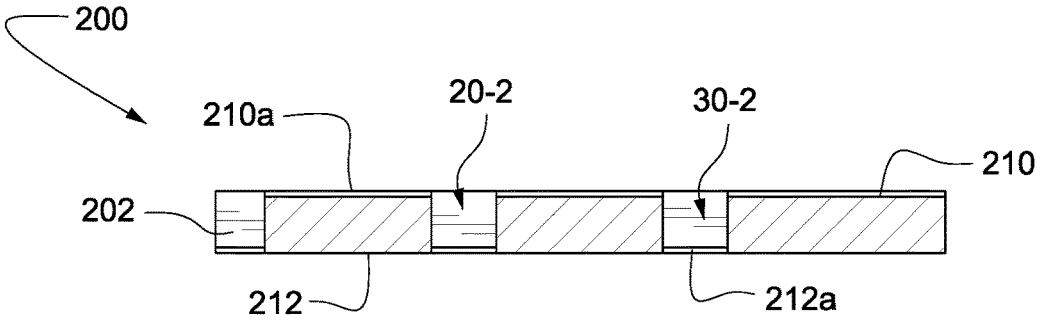
Figure 42:
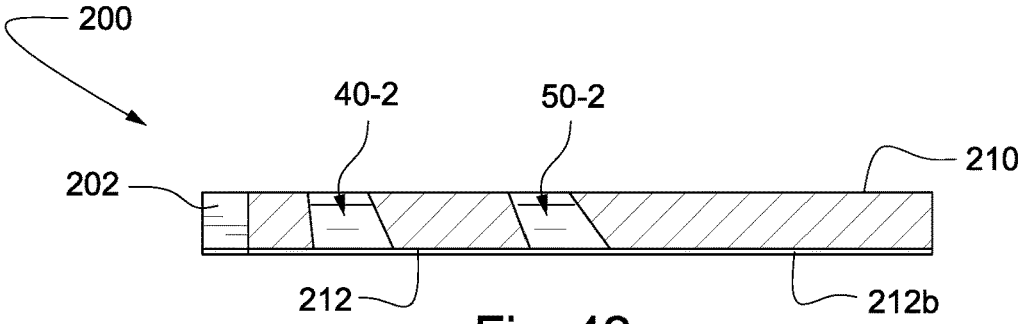
Figure 43:
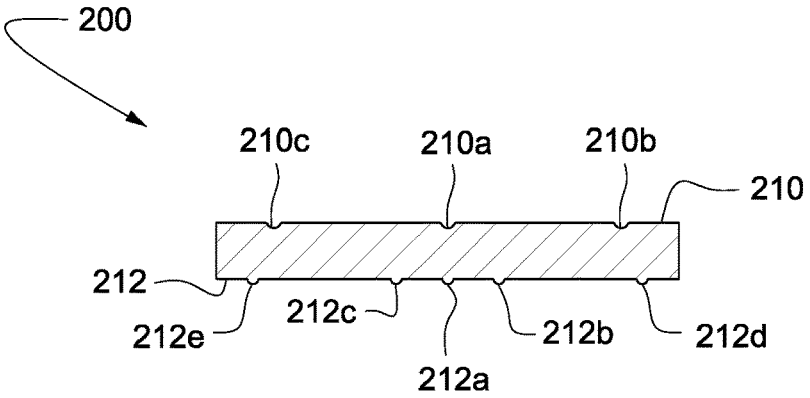
Figure 44:
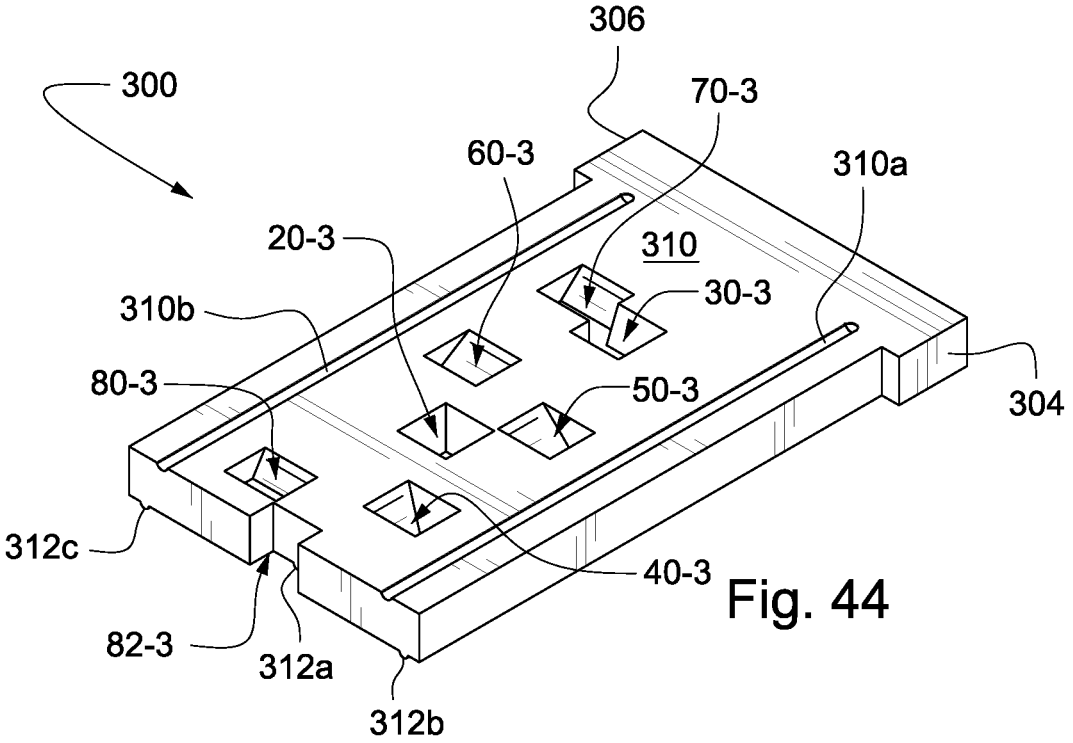
Figure 45:
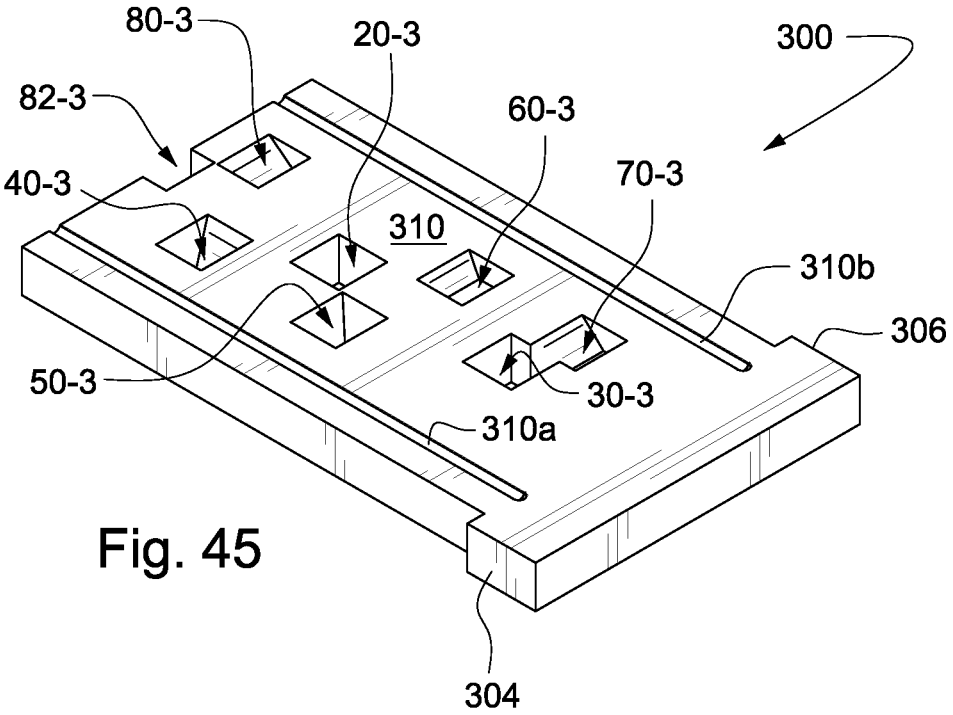
Figure 46:
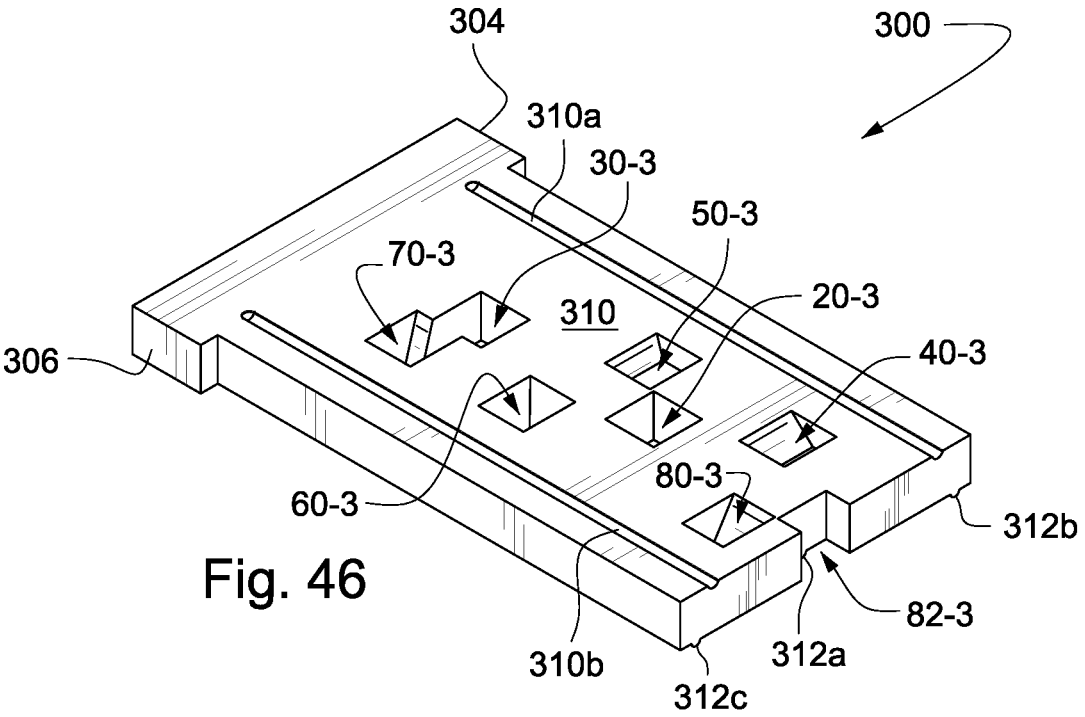
Figure 47:
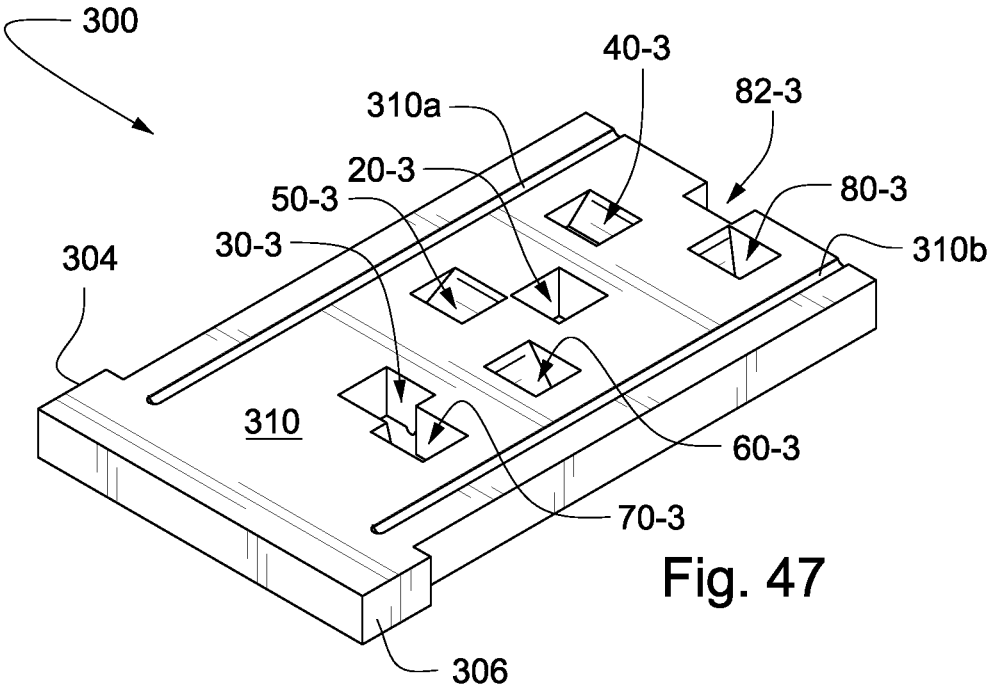
Figure 48:
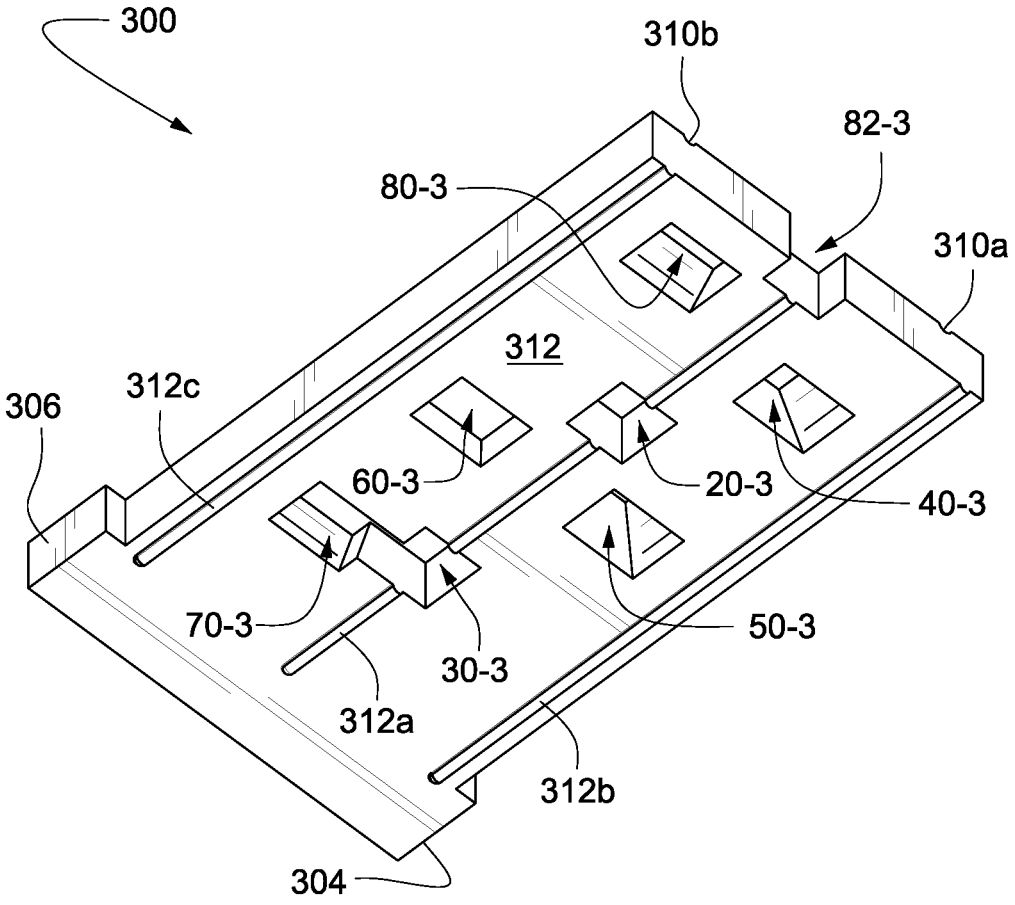
Figure 49:
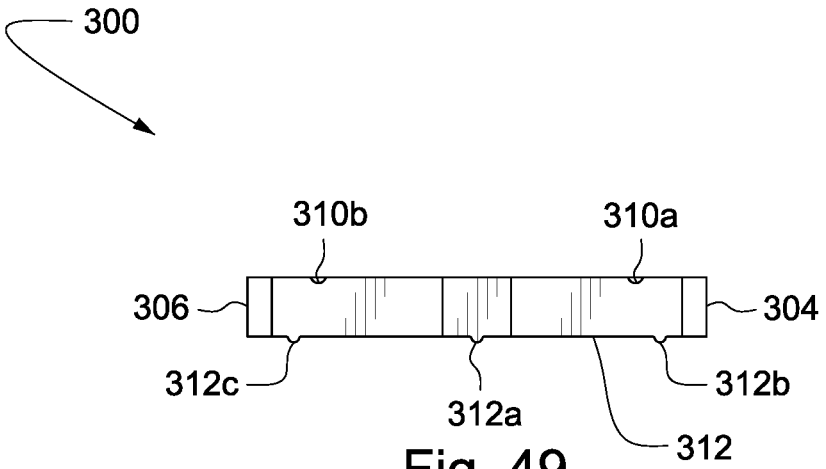
Figure 50:
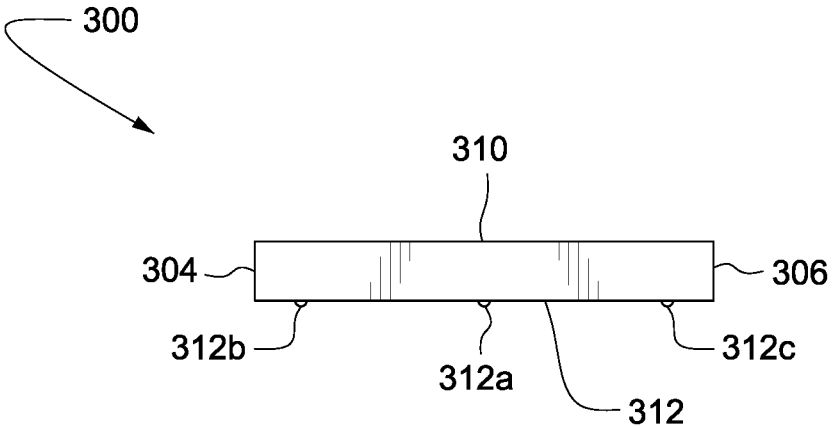
Figure 51:
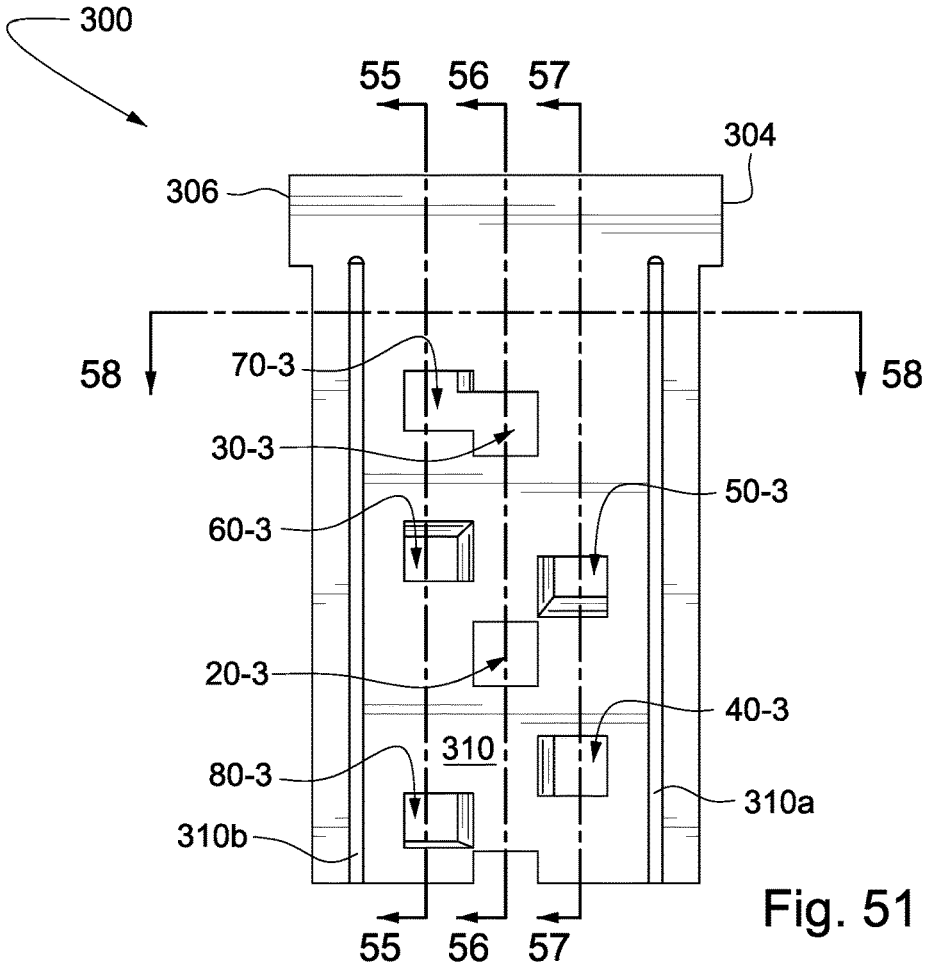
Figure 52:
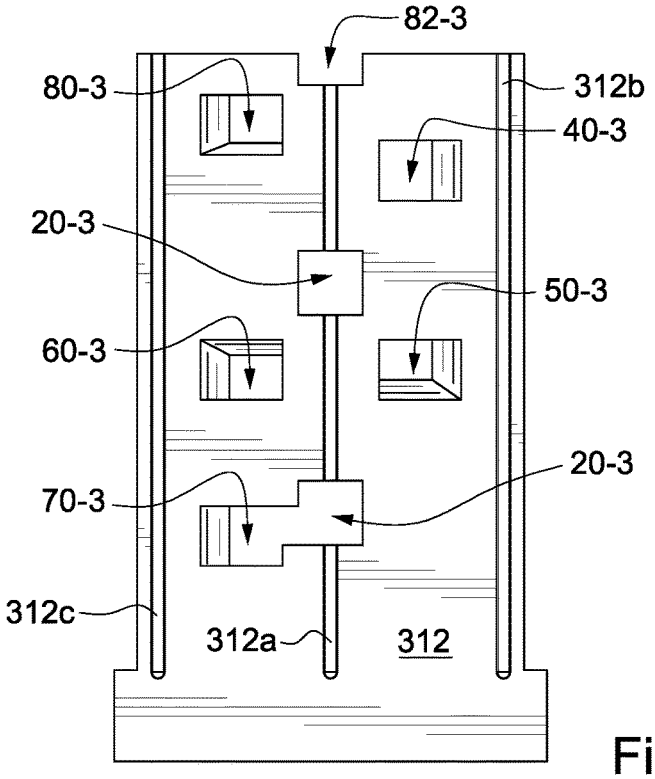
Figure 53:
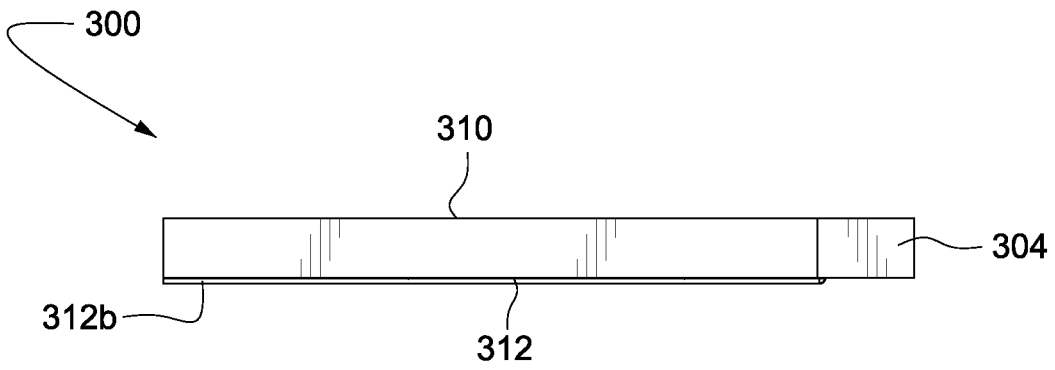
Figure 54:
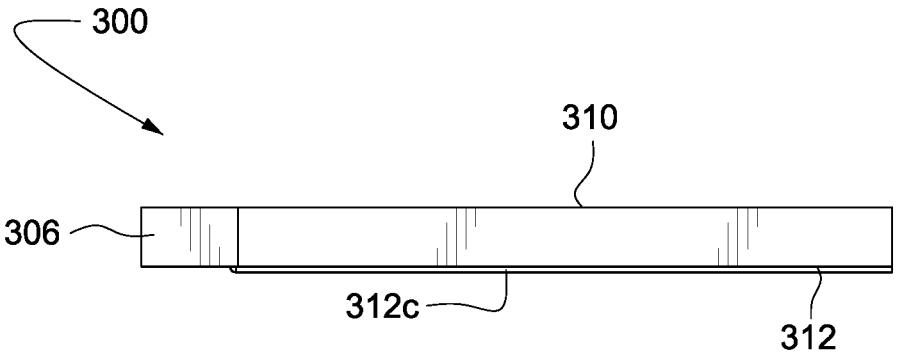
Figure 55:
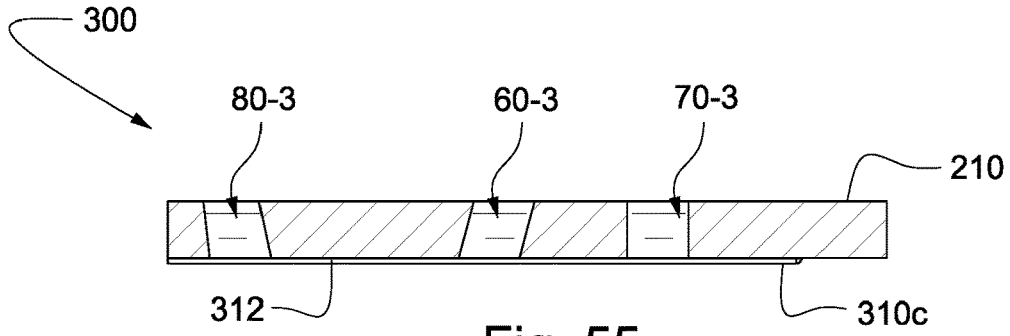
Figure 56:
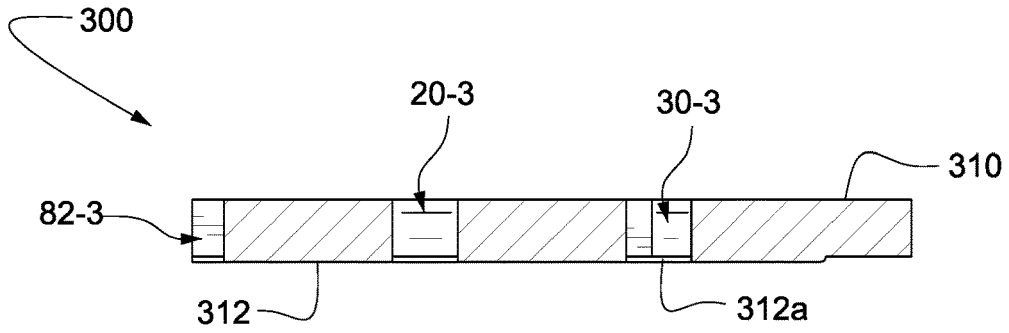
Figure 57:
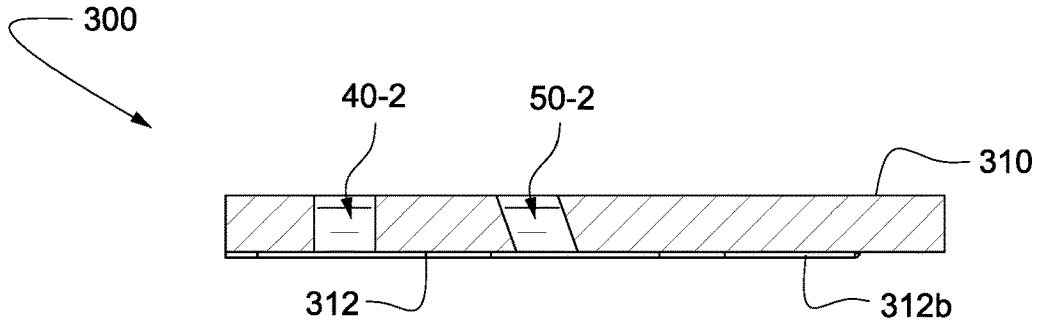
Figure 58:
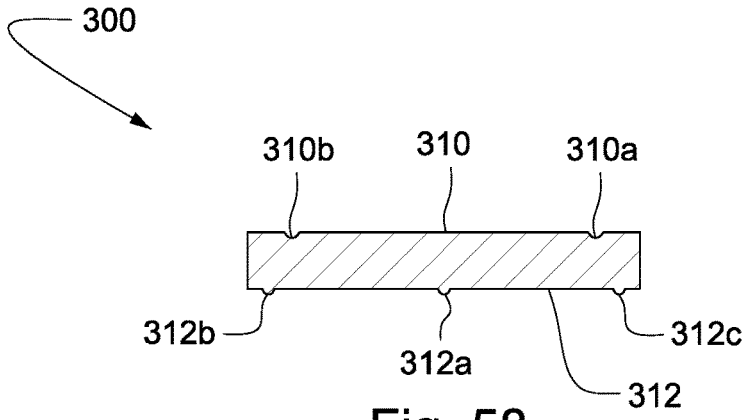
Figure 59:
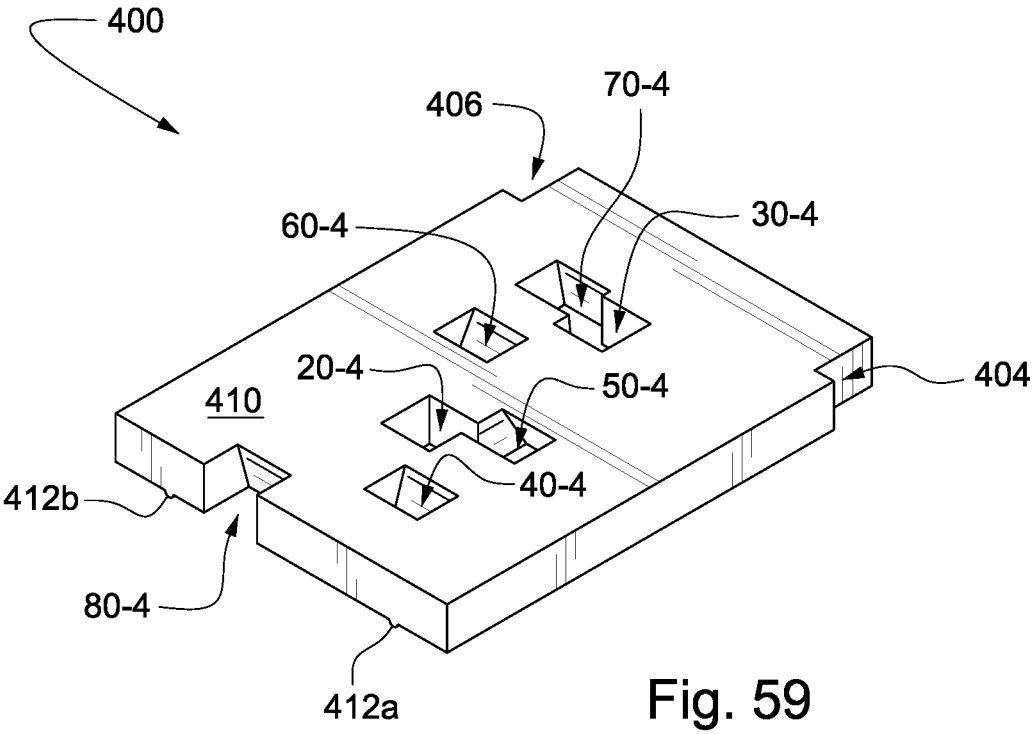
Figure 60:
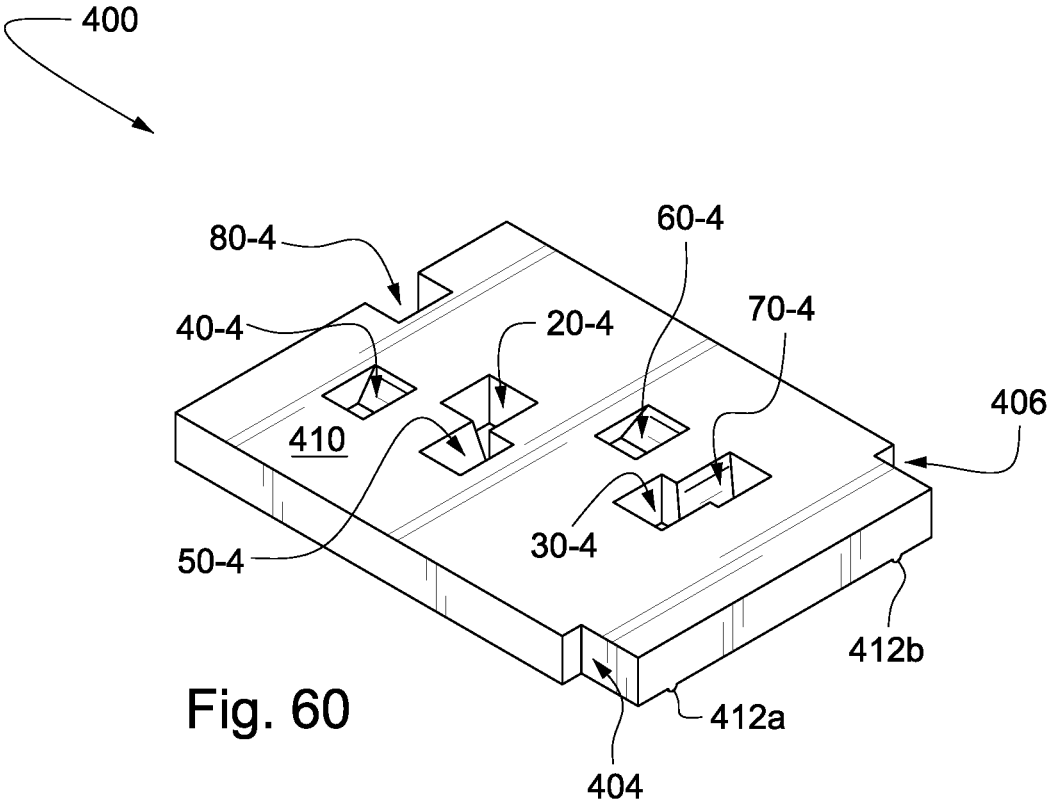
Figure 61:
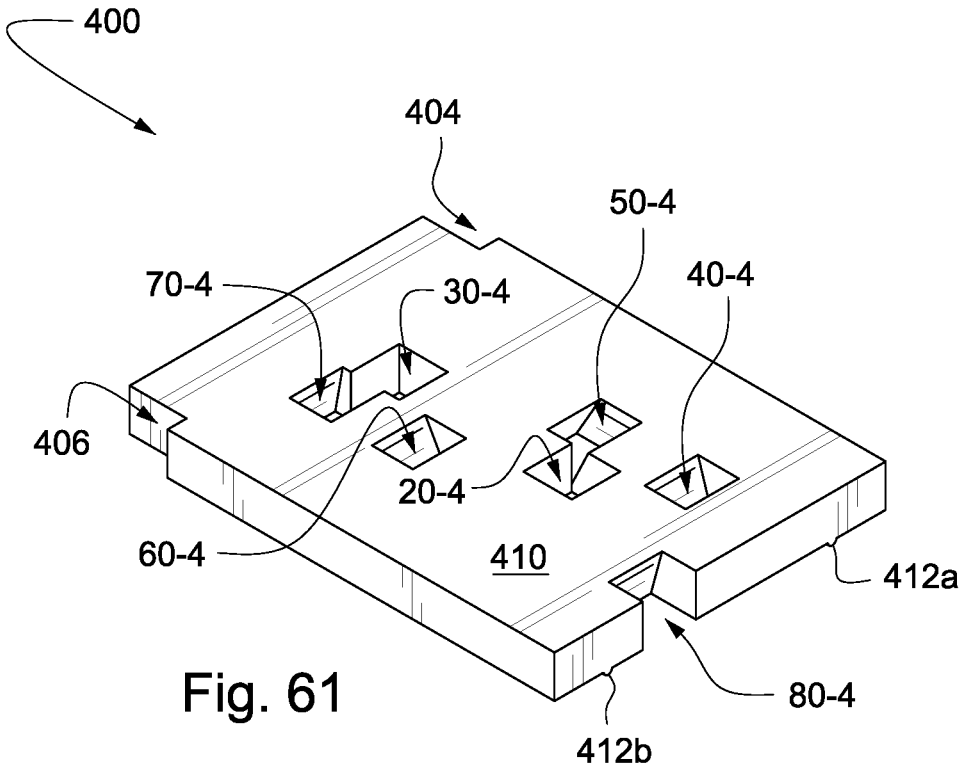
Figure 62:
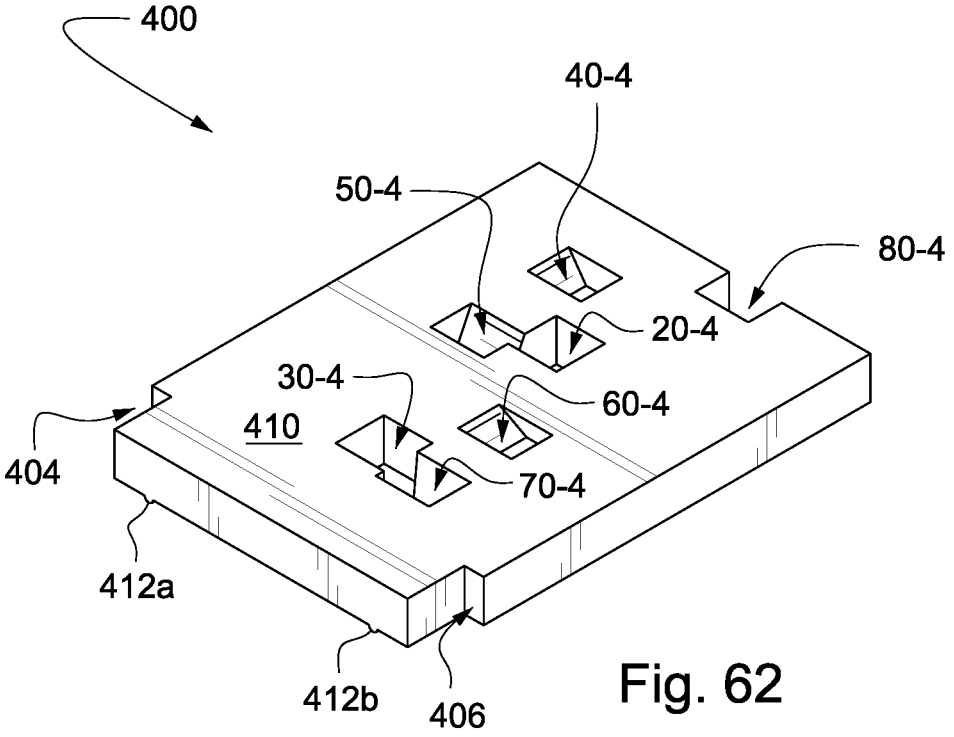
Figure 63:
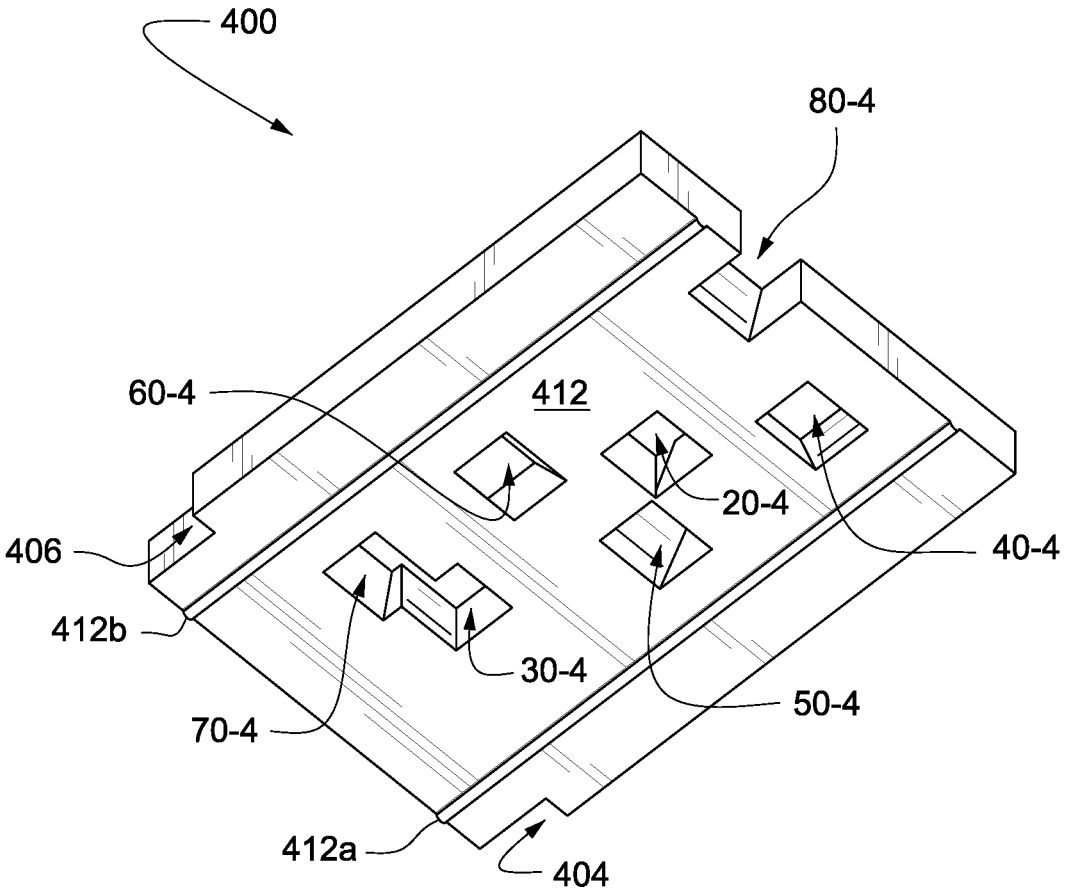
Figure 64:
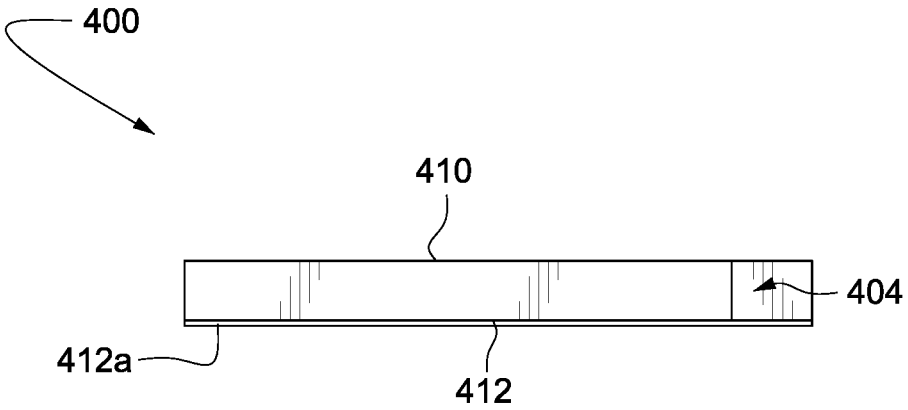
Figure 65:
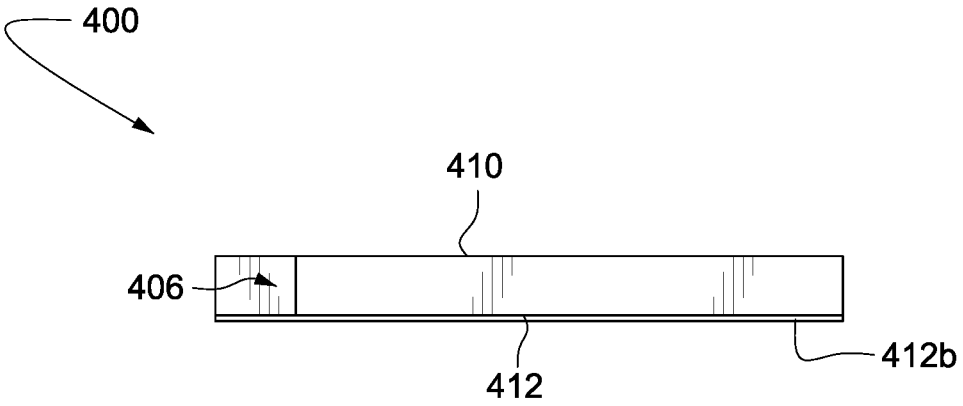
Figure 66:
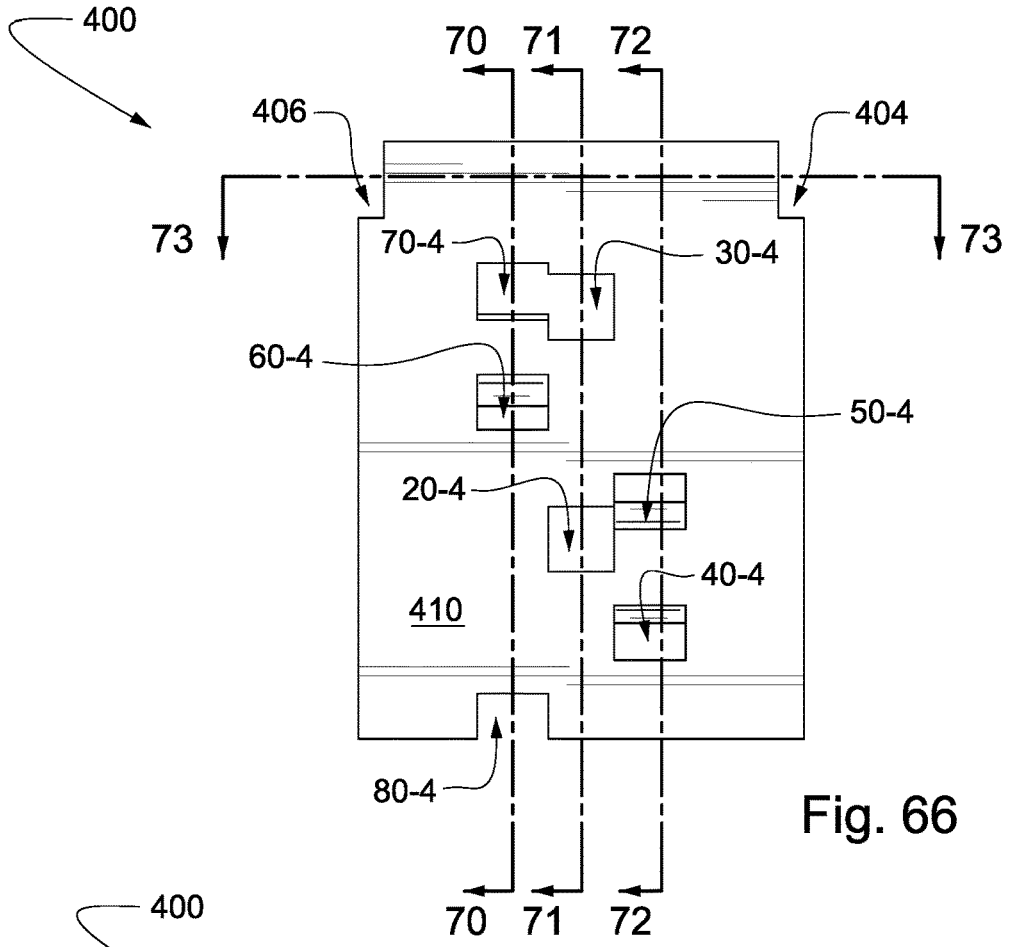
Figure 67:
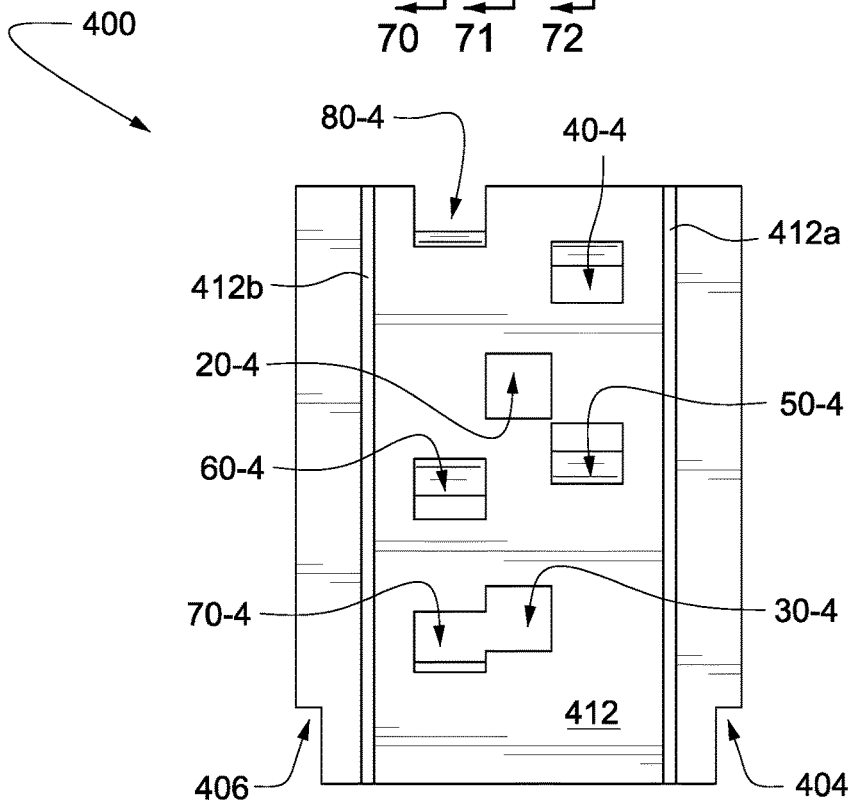
Figure 68:
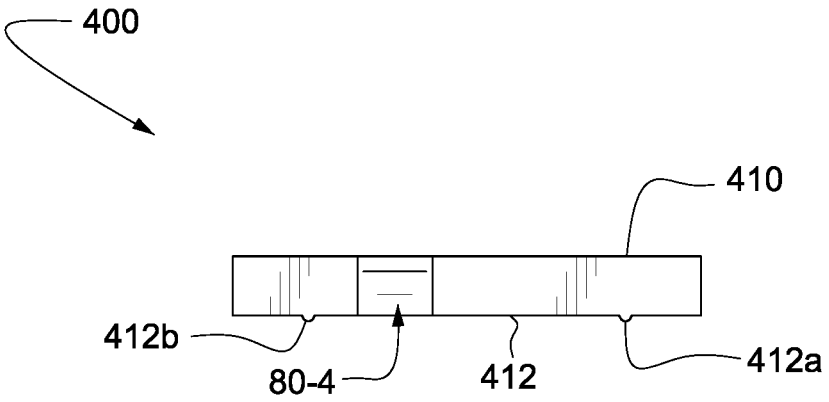
Figure 69:
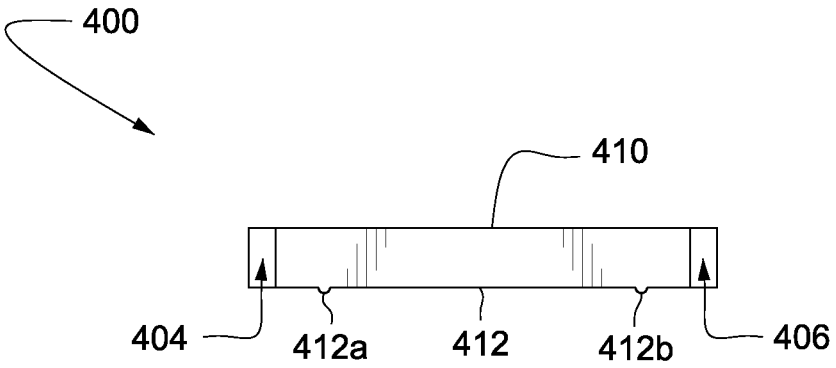
Figure 70:
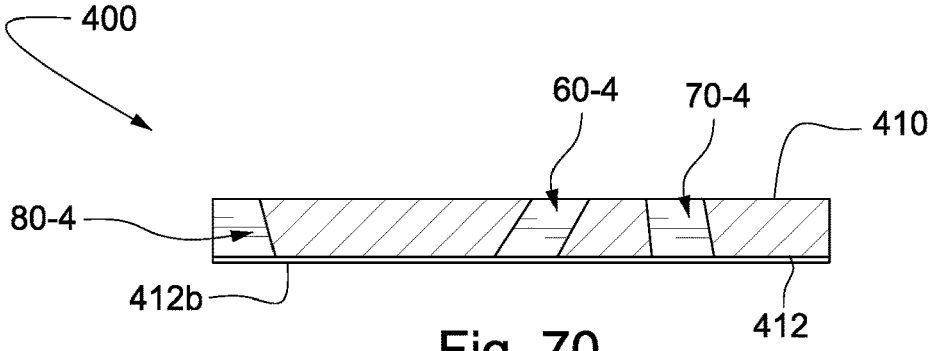
Figure 71:
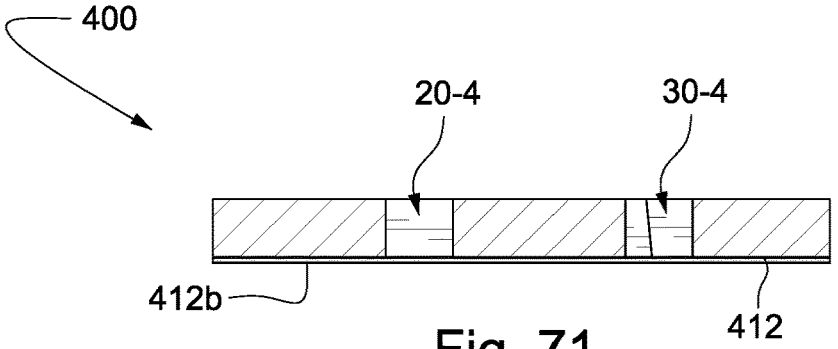
Figure 72:
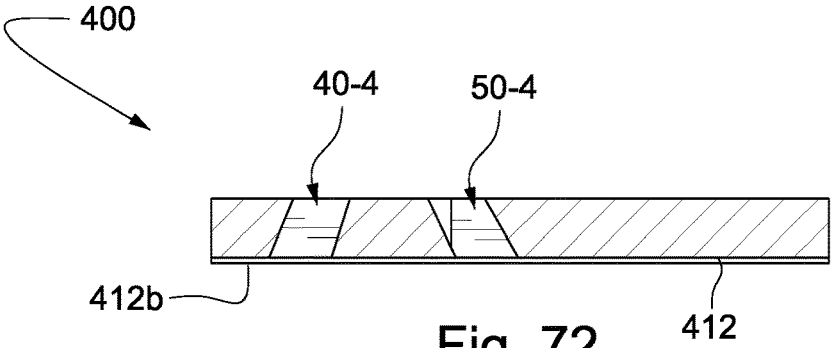
Figure 73:
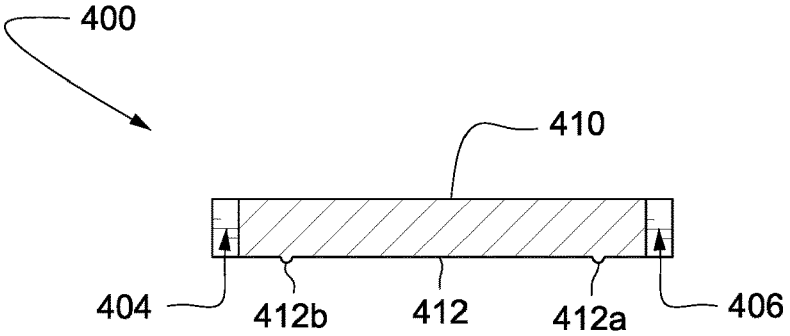
Figure 74:
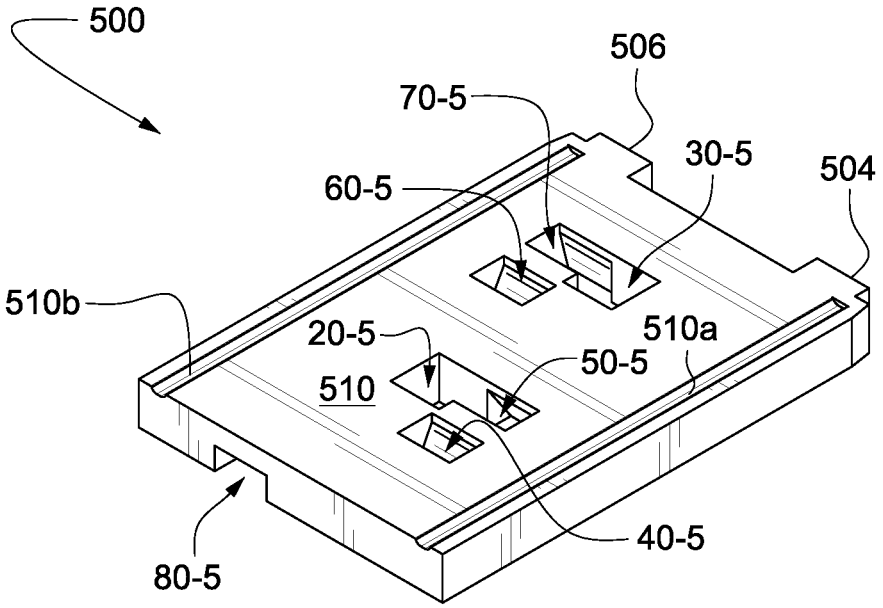
Figure 75:
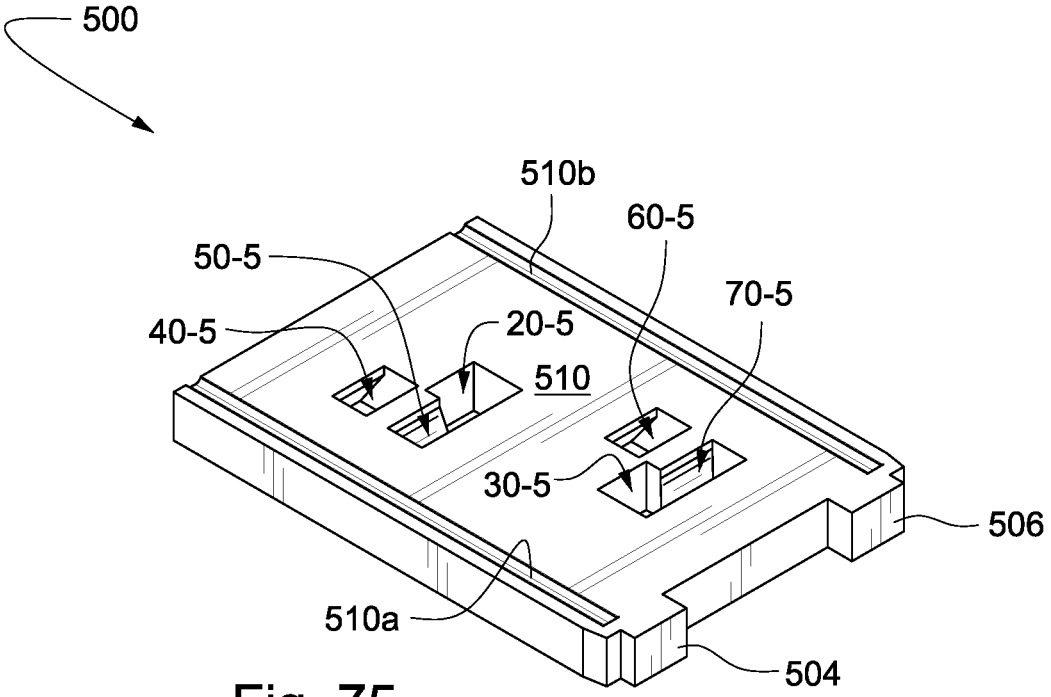
Figure 76:
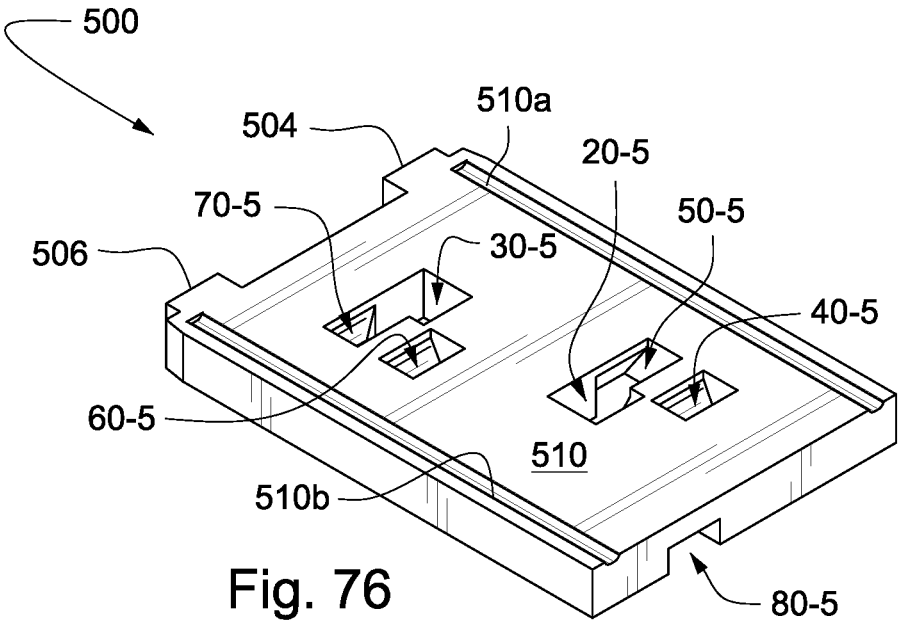
Figure 77:
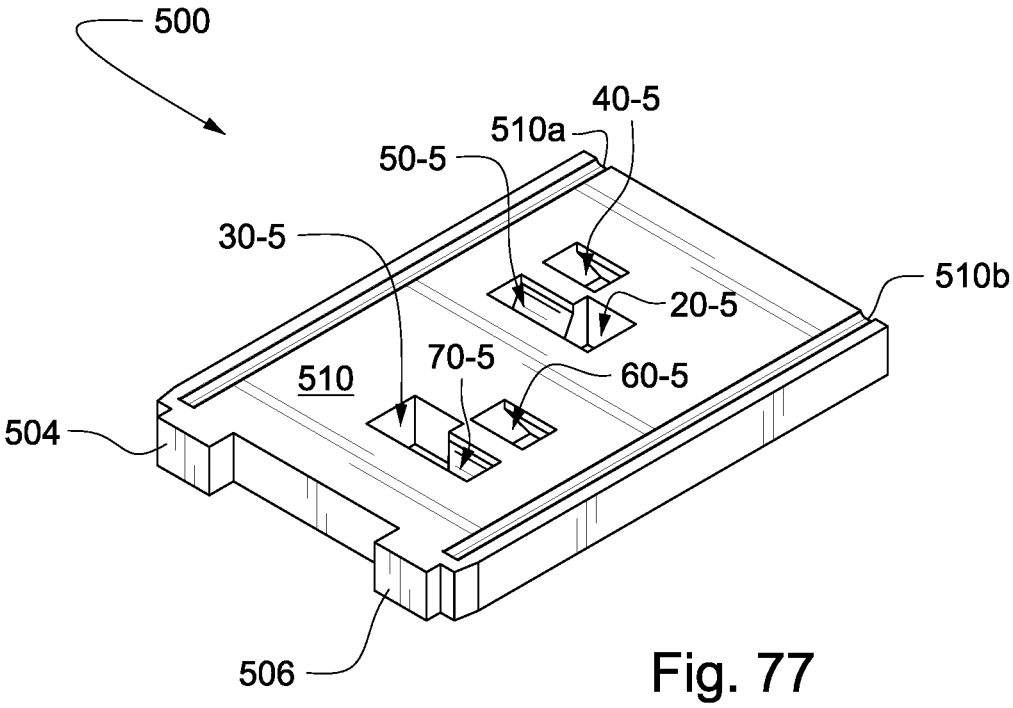
Figure 78:
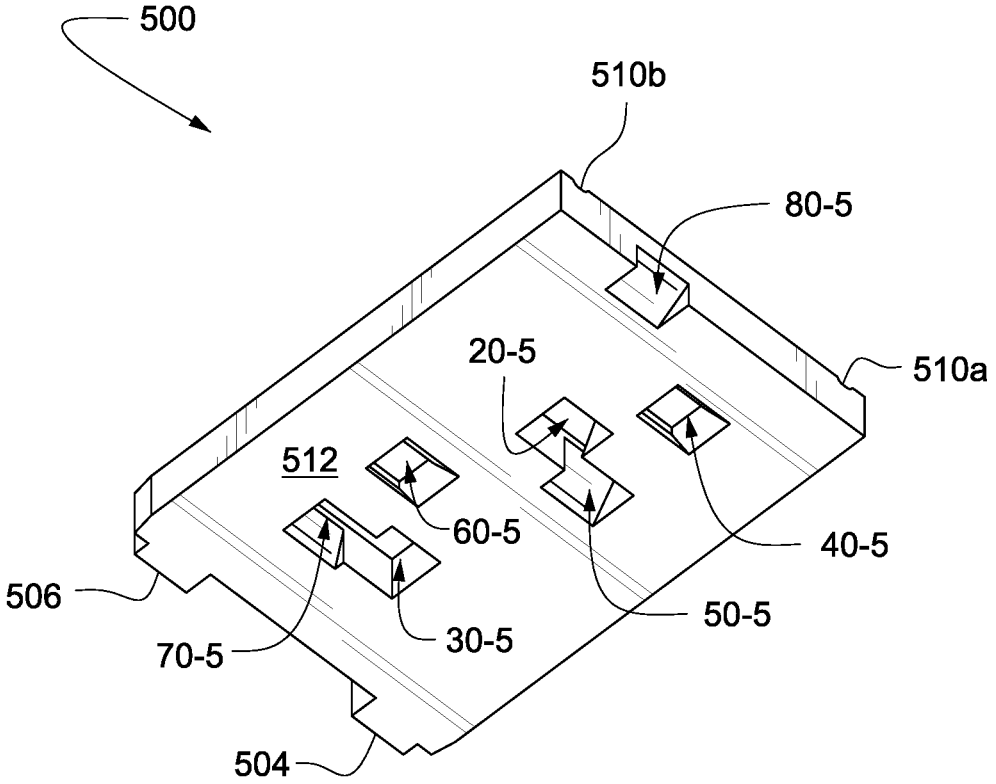
Figure 79:
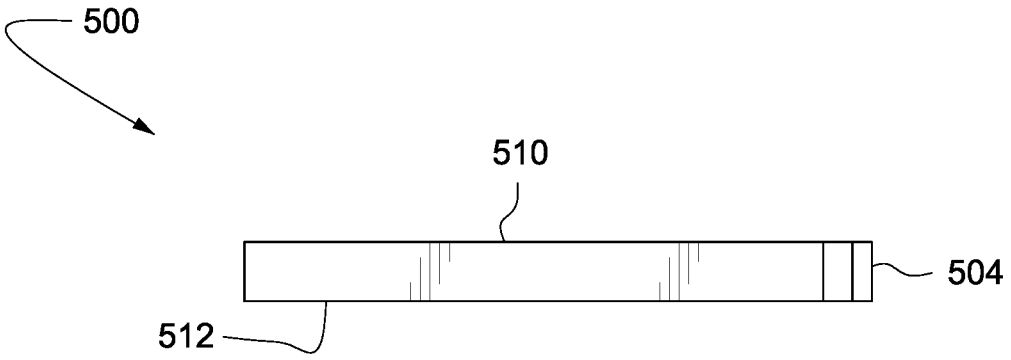
Figure 80:
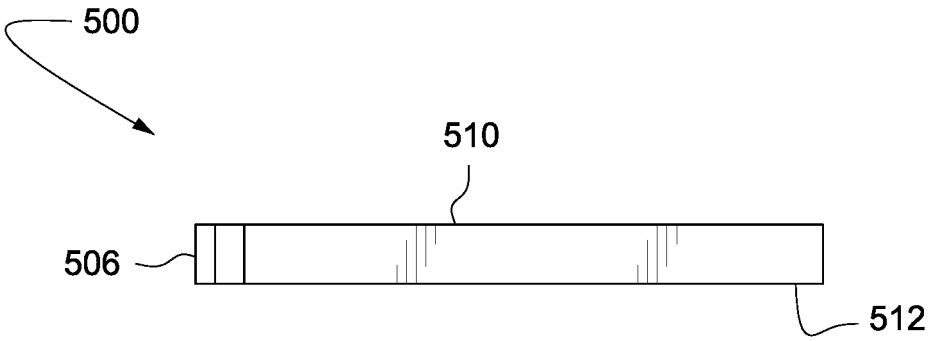
Figure 81:
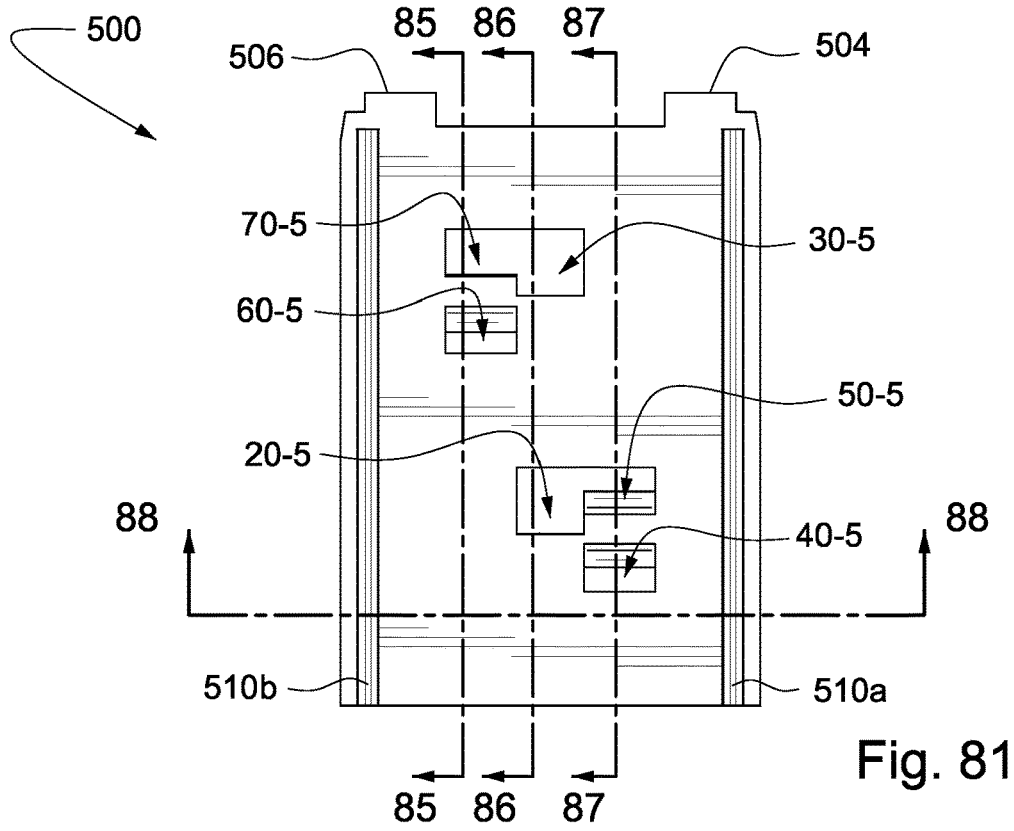
Figure 82:
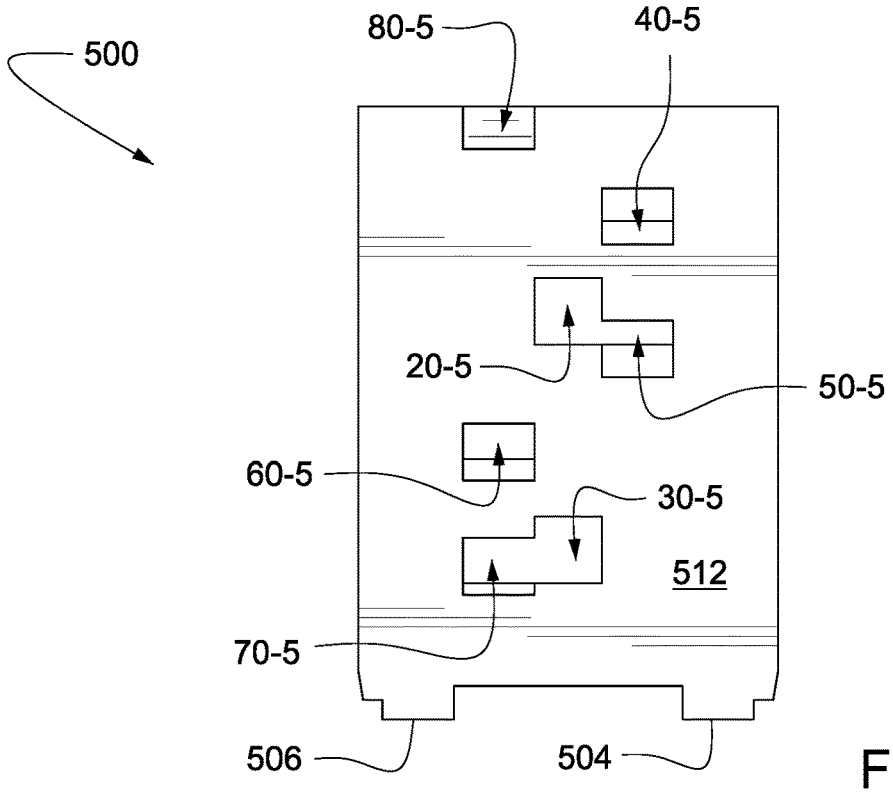
Figure 83:
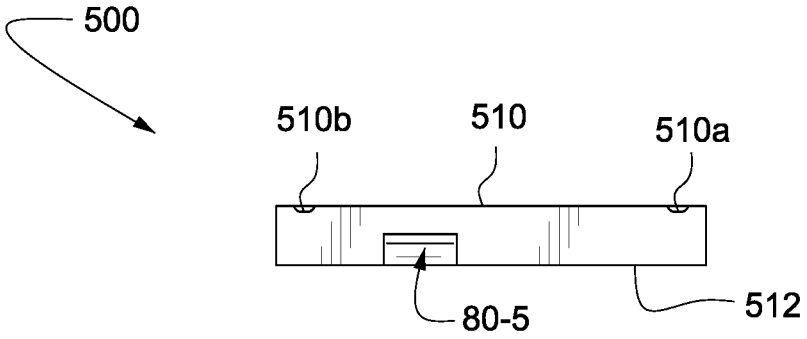
Figure 84:
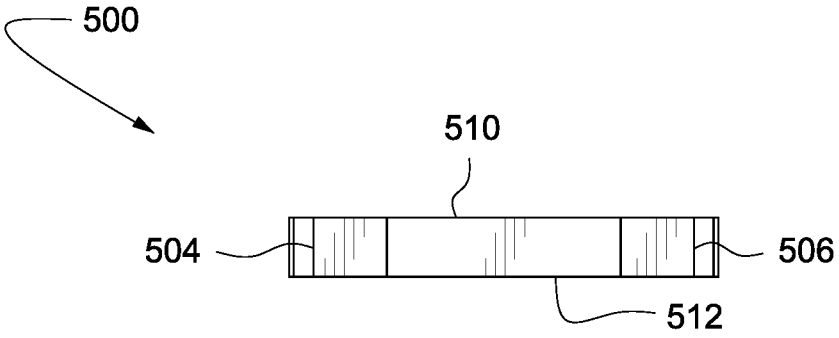
Figure 85:
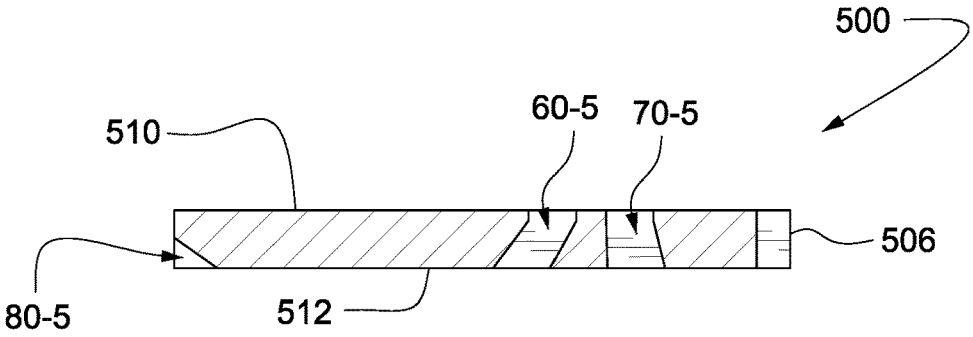
Figure 86:
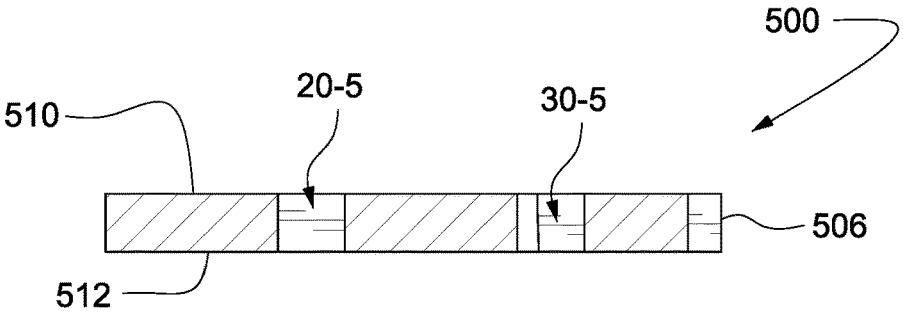
Figure 87:
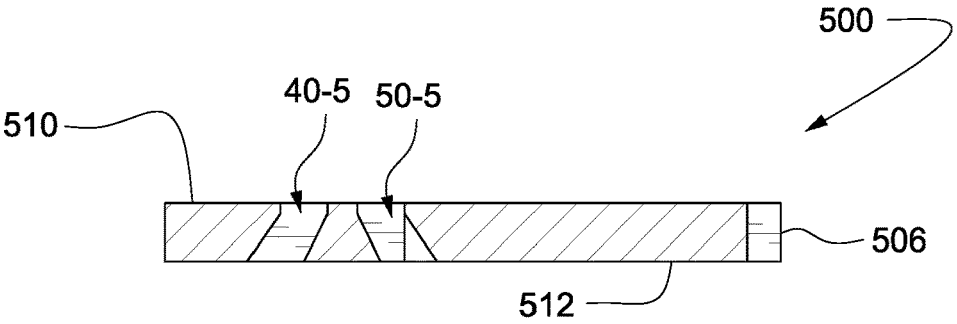
Figure 88:
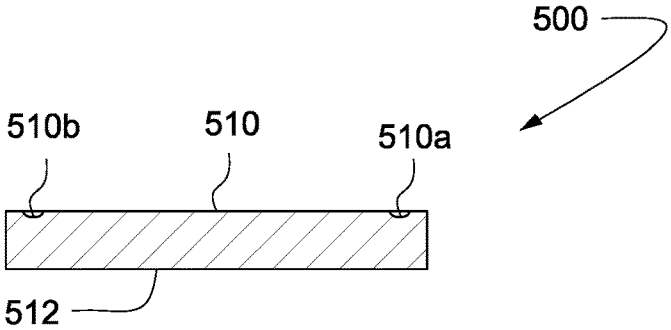

FIGS. 14-28 depict a monolithic slab of the corbel structure depicted in FIGS. 1-13 forming a first tier thereof, wherein FIGS. 14 and 15 are a right front and rear perspective views thereof, respectively, FIGS. 16 and 17 are left front and rear perspective views thereof, respectively; FIG. 18 is a bottom perspective view thereof, respectively; FIGS. 19 and 20 are top and bottom plan views thereof, respectively; FIGS. 21 and 22 are front and rear end elevation views thereof, respectively; FIGS. 23 and 24 are right and left side elevation views thereof, respectively; FIGS. 25-28 are cross-sectional elevational views thereof as taken along lines 25-25, 26-26, 27-27 and 28-28 in FIG. 19, respectively;

FIGS. 29-43 depict a monolithic slab of the corbel structure depicted in FIGS. 1-13 forming a second tier thereof, wherein FIGS. 29 and 30 are a right front and rear perspective views thereof, respectively, FIGS. 31 and 32 are left front and rear perspective views thereof, respectively; FIG. 33 is a bottom perspective view thereof, respectively; FIGS. 34 and 35 are top and bottom plan views thereof, respectively; FIGS. 36 and 37 are front and rear end elevation views thereof, respectively; FIGS. 38 and 39 are right and left side elevation views thereof, respectively; FIGS. 40-43 are cross-sectional elevational views thereof as taken along lines 40-40, 41-41, 42-42 and 43-43 in FIG. 36, respectively;

FIGS. 44-58 depict a monolithic slab of the corbel structure depicted in FIGS. 1-13 forming a third tier thereof, wherein FIGS. 44 and 45 are a right front and rear perspective views thereof, respectively, FIGS. 46 and 47 are left front and rear perspective views thereof, respectively; FIG. 48 is a bottom perspective view thereof, respectively; FIGS. 49 and 50 are front and rear end elevation views thereof, respectively; FIGS. 51 and 52 are top and bottom plan views thereof, respectively; FIGS. 53 and 54 are right and left side elevation views thereof, respectively; FIGS. 55-58 are cross-sectional elevational views thereof as taken along lines 55-55, 56-56, 57-57 and 58-58 in FIG. 51, respectively;

FIGS. 59-73 depict a monolithic slab of the corbel structure depicted in FIGS. 1-13 forming a fourth tier thereof, wherein FIGS. 59 and 60 are a right front and rear perspective views thereof, respectively, FIGS. 61 and 62 are left front and rear perspective views thereof, respectively; FIG. 63 is a bottom perspective view thereof, respectively; FIGS. 64 and 65 are front and rear end elevation views thereof, respectively; FIGS. 66 and 67 are top and bottom plan views thereof, respectively; FIGS. 68 and 69 are right and left side elevation views thereof, respectively; FIGS. 70-73 are cross-sectional elevational views thereof as taken along lines 70-70, 71-71, 72-72 and 73-73 in FIG. 66, respectively; and FIGS. 74-88 depict a monolithic slab of the corbel structure depicted in FIGS. 1-13 forming a fifth tier thereof, wherein FIGS. 74 and 75 are a right front and rear perspective views thereof, respectively, FIGS. 76 and 77 are left front and rear perspective views thereof, respectively; FIG. 78 is a bottom perspective view thereof, respectively; FIGS. 79 and 80 are front and rear end elevation views thereof, respectively; FIGS. 81 and 82 are top and bottom plan views thereof, respectively; FIGS. 83 and 84 are right and left side elevation views thereof, respectively; FIGS. 85-88 are cross-sectional elevational views thereof as taken along lines 85-85, 86-86, 87-87 and 88-88 in FIG. 81, respectively.

DETAILED DESCRIPTION

Accompanying FIGS. 1-13 show an exemplary corbel structure 10 in accordance with an embodiment of the present invention. In this regard, it will be understood that a conventional coke oven battery will include a number of spaced apart piers (not shown), each supporting a corbel structure 10 and defining therebetween regenerator regions provided with checker bricks (not shown). The corbel structures 10 in turn support the refractory walls and floors of the individual coke ovens (not shown).

As depicted in FIGS. 1-13, the corbel structure 10 is comprised of essentially five tiers or courses T1, T2, T3, T4 and T5 (see FIG. 1) each of which includes a monolithic corbel slab 100, 200, 300, 400 and 500, respectively, stacked one on top of another as will be described in greater detail below. The courses 100, 200, 300 and 400 collectively define central substantially vertically oriented central fuel gas passageways 20, 30 and respective pairs of lateral combustion air passages 40, 50 and 60, 70 which communicate with corresponding flues within the walls of the coke oven (not shown) to allow for the burning of air and gas therein and the transport of heated waste gas to and from the regenerator regions. In this regard, it will be understood by those skilled in this art that the embodiment depicted in the accompanying drawing Figures services each of a pair of adjacent flues in the coke oven with a respective one of the fuel gas passageways 20, 30 and respective pairs of the combustion air passages 40, 50 and 60, 70.

A stacked plurality of fuel gas blocks 22, 32 defining central fuel gas conduit 24, 34 are positioned within the central passageways 20, 30, respectively. By way of example, the fuel gas blocks 22, 32 may be configured as described in the above-identified US Published Patent Application No. 2016/0281983.

A number of lateral edge blocks, a representative few of which are identified by reference numerals 15, 25, and 35, may be provided at each lateral edge of a central slab 100, 200 and 300 forming tiers T1, T2 and T3, respectively. Design needs may dictate that other configurations and/or numbers of such lateral edge blocks are provided depending on the particular corbel needed for a particular coke oven.

Accompanying FIGS. 14-28 depict the structural details of the central slab 100 forming the first tier T1 of the corbel 10. As can be seen, the slab 100 defines an initial vertically oriented fuel gas passageway portions 20-1, 30-1 of the central fuel gas passageways 20, 30, respectively, as well as initial inclined combustion air passageway portions 40-1, 50-1, 60-1 and 70-1 of the lateral combustion air passageways 40, 50, 60 and 70, respectively.

A central finger element 102 extending from a front end of the slab 100 may be provided with asymmetrically dimensioned sides so as to mate with corresponding refractory blocks of an adjacent corbel structure (not shown). Similarly, an opposed pair of laterally extending finger elements 104, 106 may extend from opposed side edges of the slab 100 so as to mate with corresponding refractory blocks of the corbel wall (not shown).

As shown in FIGS. 14-17, the top surface 110 of the slab 100 may be provided with longitudinally extending parallel arcuate grooves 110*a*-110*e*, while the bottom surface 112 of the slab 100 is provided with outwardly projecting parallel arcuate tongues 112*a*-112*c* (see FIG. 18).

Accompanying FIGS. 29-43 depict the structural details of the central slab 200 forming the second tier T2 of the corbel 10. As can be seen, the slab 200 defines intermediate vertically oriented fuel gas passageway portions 20-2, 30-2 of the central fuel gas passageways 20, 30, respectively, as well as intermediate inclined combustion air passageway portions 40-2, 50-2, 60-2 and 70-2 of the lateral combustion air passageways 40, 50, 60 and 70, respectively.

An asymmetrically off-set finger element 202 extending from a front end of the slab 200 may be provided so as to mate with corresponding refractory blocks of an adjacent corbel structure (not shown). In addition, an inside edge of the finger element 202 and a portion of the end edge of the slab 200 will at least partially define a central fuel gas passageway associated with an adjacent flue of the coke oven (not shown). Similarly, an opposed pair of laterally extending finger elements 204, 206 may extend from opposed side edges of the slab 200 so as to mate with corresponding refractory blocks of the corbel wall (not shown). An additional inclined passageway portion 80-2 is defined in the slab 200 rearwardly of the finger element 202 so as to communicate with portion of combustion air passageway associated with a laterally adjacent corbel structure servicing an adjacent flue of the coke oven (not shown).

As shown in FIGS. 29-32, the top surface 210 of the slab 200 may be provided with longitudinally extending parallel arcuate grooves 210*a*-210*c*, while the bottom surface 212 of the slab 200 is provided with outwardly projecting parallel arcuate tongues 212*a*-112*e* (see FIG. 33) which are sized and configured to be received within the grooves 110*a*-110*e*, respectively, of the slab 100 when the slab 200 is positioned in a stacked relationship on the top surface 110 of the slab 100 when constructing the corbel 10.

Accompanying FIGS. 44-58 depict the structural details of the central slab 300 forming the third tier T3 of the corbel 10. As can be seen, the slab 300 defines intermediate vertically oriented fuel gas passageway portions 20-3, 30-3 of the central fuel gas passageways 20, 30, respectively, as well as intermediate inclined combustion air passageway portions 40-3, 50-3, 60-3 and 70-3 of the lateral combustion air passageways 40, 50, 60 and 70, respectively. The intermediate vertically oriented fuel gas passageway portion 30-3 and the intermediate inclined combustion air passageway portion 70-3 are conjoined with one another so as to collectively define a common (unitary) passageway through the slab 300.

A notch 82-3 is formed at the front end of the slab 300 so as to mate with the inside edge of the finger element 202 and rear edges of the slab 200 so as to further establish a central fuel gas passageway associated with an adjacent flue of the coke oven (not shown). An opposed pair of laterally extending finger elements 304, 306 may extend from opposed side edges of the slab 300 so as to mate with corresponding refractory blocks of the corbel wall (not shown).

As shown in FIGS. 44-47, the top surface 310 of the slab 200 may be provided with longitudinally extending parallel arcuate grooves 210*a*-210*c*, while the bottom surface 312 of the slab 300 is provided with outwardly projecting parallel arcuate tongues 312*a*-312*c* (see FIG. 48) which are sized and configured to be received within the grooves 210*a*-210*c*, respectively, of the slab 200 when the slab 300 is positioned in a stacked relationship on the top surface 210 of the slab 200 when constructing the corbel 10.

Accompanying FIGS. 59-73 depict the structural details of the central slab 400 forming the fourth tier T4 of the corbel 10. As can be seen, the slab 400 defines intermediate vertically oriented fuel gas passageway portions 20-4, 30-4 of the central fuel gas passageways 20, 30, respectively, as well as intermediate inclined combustion air passageway portions 40-4, 50-4, 60-4 and 70-4 of the lateral combustion air passageways 40, 50, 60 and 70, respectively. The intermediate vertically oriented fuel gas passageway portion 30-4 and the intermediate inclined combustion air passageway portion 70-4 are conjoined with one another so as to collectively define a common (unitary) passageway through the slab 400.

A U-shaped notch 80-4 having an inclined interior wall is asymmetrically formed at the front end of the slab 400 so as to mate with the passageway 80-3 formed in the subjacent slab 300 so as to further establish a central fuel gas passageway associated with an adjacent flue of the coke oven (not shown). An opposed pair of notches 404, 406 are defined in the correspondingly opposed side edges of the slab 400 so as to mate with an edge block associated with the corbel wall (not shown).

As shown in FIGS. 59-63, the top surface 410 of the slab 400 is smoothly planar while the bottom surface 412 of the slab 400 is provided with outwardly projecting parallel arcuate tongues 412*a*-412*b* (see FIG. 63) which are sized and configured to be received within the grooves 310*a*-310*b*, respectively, of the slab 300 when the slab 400 is positioned in a stacked relationship on the top surface 310 of the slab 300 when constructing the corbel 10.

Accompanying FIGS. 74-88 depict the structural details of the central slab 500 forming the fifth tier T5 of the corbel 10. As can be seen, the slab 500 defines intermediate vertically oriented fuel gas passageway portions 20-5, 30-5 of the central fuel gas passageways 20, 30, respectively, as well as intermediate inclined combustion air passageway portions 40-5, 50-5, 60-5 and 70-5 of the lateral combustion air passageways 40, 50, 60 and 70, respectively. The intermediate vertically oriented fuel gas passageway portions 20-5, 30-5 and the intermediate inclined combustion air passageway portion 50-5*m* 70-5 are respectively conjoined with one another so as to collectively define a common (unitary) passageway through the slab 500.

A blind notch 80-5 having an inclined interior wall is asymmetrically formed in the bottom surface 512 at the front end of the slab 500 so as to mate with the U-shaped notch 80-4 formed in the subjacent slab 400 so as to further establish a central fuel gas passageway associated with an adjacent flue of the coke oven (not shown). An opposed pair of forwardly projecting fingers 404, 506 are defined at the rear edge of the slab 500.

As shown in FIGS. 74-77, the top surface 510 of the slab 400 may be provided with longitudinally extending parallel arcuate grooves 510*a*, 510*b* so as to allow additional refractory blocks and/or slabs (not shown) to be stacked thereon when constructing the corbel 10. The bottom surface 512 of the slab 500 is however smoothly planar so as to be positioned directly against the correspondingly smoothly planar top surface 410 of the subjacent slab 400 when the former is stacked on top of the latter when constructing the corbel structure 10.

It will be understood that the description provided herein is presently considered to be the most practical and preferred embodiments of the invention. Thus, the invention is not to be limited to the disclosed embodiments, but on the contrary, is intended to cover various modifications and equivalent arrangements included within the spirit and scope thereof.

What is claimed is:

1. A corbel structure for a coke oven comprising:

an assembly of a multiple number of stacked monolithic refractory slabs defining a corresponding multiple number of tiers of the corbel structure which define a pair of substantially vertically oriented central fuel gas passageways and pairs of combustion air passageways positioned laterally of a respective one of the central fuel gas passageways, and a plurality of vertically stacked fuel gas blocks each defining a central fuel gas conduit positioned within each of the central fuel gas passageways, wherein an intermediate one of the monolithic refractory slabs defines a common passageway which includes both an intermediate portion of one of the central fuel gas passageways and an intermediate portion of one of the combustion air passageways, wherein the intermediate portions of the central fuel gas passageway and the one combustion air passageway are conjoined to one another so as to establish the common passageway in the intermediate one of the monolithic refractory slabs.

2. The corbel structure according to claim 1, wherein a first pair of the combustion air passageways is positioned laterally to one side of a first respective central fuel gas passageway and a second pair of the combustion air passageways is positioned laterally of a second respective central fuel gas passageway at an opposite side thereof relative to the one side.

3. The corbel structure according to claim 1, wherein each of the combustion air passageways comprise an inclined segment between a bottom opening and a top opening thereof.

4. The corbel structure according to claim 1, wherein at least one of the combustion air passageways includes a vertically oriented segment in at least one of the slabs.

5. The corbel structure according to claim 4, wherein at least two of the slabs define vertically oriented segments of at least one of the combustion air passageways.

6. The corbel structure according to claim 1, wherein at least one of the slabs defines a pair of elongate parallel grooves in an upper surface thereof and a pair of elongate tongues protruding from a bottom surface thereof so as to mate with respectively corresponding pairs of elongate tongues and grooves formed in superjacent and subjacent slabs in the stack.

7. The corbel structure according to claim 1, wherein at least a plurality of the slabs in the stack partially define an additional combustion air passageway associated with an adjacent flue of the coke oven.

8. The corbel structure according to claim 1, further comprising a stacked plurality of edge blocks at side edges of at least a plurality of slabs in the stack.

9. The corbel structure according to claim 1, wherein at least one of the slabs in the stack comprises a finger element protruding from one end thereof.

* * * * *